US012473678B2

(12) United States Patent
Monjo

(10) Patent No.: US 12,473,678 B2
(45) Date of Patent: Nov. 18, 2025

(54) DEVICE FOR ASSISTING WITH THREADING THE EYE OF A NEEDLE

(71) Applicant: MATERIEL POUR L'ARBORICULTURE FRUITIERE, Montauban (FR)

(72) Inventor: Jacques Monjo, La Crau (FR)

(73) Assignee: MATERIEL POUR L'ARBORICULTURE FRUITIERE, Montauban (FR)

( * ) Notice: Subject to any disclaimer, the term of this patent is extended or adjusted under 35 U.S.C. 154(b) by 9 days.

(21) Appl. No.: 18/835,565

(22) PCT Filed: Feb. 2, 2023

(86) PCT No.: PCT/IB2023/050934

§ 371 (c)(1),
(2) Date: Aug. 2, 2024

(87) PCT Pub. No.: WO2023/148664

PCT Pub. Date: Aug. 10, 2023

(65) Prior Publication Data

US 2025/0137180 A1 May 1, 2025

(30) Foreign Application Priority Data

Feb. 2, 2022 (FR) ..... 2200929

(51) Int. Cl.
*D05B 87/02* (2006.01)
*D05B 87/00* (2006.01)

(52) U.S. Cl.
CPC ..... *D05B 87/02* (2013.01); *D05B 87/00* (2013.01)

(58) Field of Classification Search
CPC ..... D05B 87/00; D05B 87/02; D05B 87/04; A01K 91/04

(Continued)

(56) References Cited

U.S. PATENT DOCUMENTS 638,701 A 12/1899 Childers
707,191 A 8/1902 Aicardi
(Continued)

FOREIGN PATENT DOCUMENTS

AT 1901 U1 1/1998
DE 0322966 C 7/1920
(Continued)

OTHER PUBLICATIONS

International Search Report for International Application No. PCT/IB2023/050934, mailed May 8, 2023, 6 pages with English translation.

(Continued)

*Primary Examiner* — Danny Worrell
(74) *Attorney, Agent, or Firm* — TraskBritt

(57) ABSTRACT

A device for assisting with threading an eyed needle with the eye being of a type peripherally delimited by a rim extending substantially in a plane includes a solid body forming an eye receiving portion designed to receive the eye of the needle and to keep the needle in position in relation to the solid body. A passage in the solid body includes a guide portion that forms a first funnel for guiding the hook to bring the hook out of a retracted position and into a threading position. The guide portion also forms a second funnel for returning the hook to the retracted position from the threading position. Each time the hook transitions from and back to the retracted position, the hook moves through the eye of the needle, drawing the thread through the eye when the hook returns to the retracted position from the threading position.

21 Claims, 15 Drawing Sheets

(58) Field of Classification Search
USPC ..... 112/225, 227, 224, 302; 289/17; 223/99
See application file for complete search history.

(56) References Cited

U.S. PATENT DOCUMENTS

| | | | | | |
|---|---|---|---|---|---|
| 1,147,656 | A | | 7/1915 | Spear | |
| 2,490,883 | A | * | 12/1949 | Pinkham | D05B 87/00 223/99 |
| 2,507,370 | A | * | 5/1950 | Edwards | D05B 87/00 223/99 |
| 2,656,956 | A | * | 10/1953 | Kahn | D05B 87/00 223/99 |
| 2,777,623 | A | * | 1/1957 | Balzer | D05B 87/00 223/99 |
| 4,697,370 | A | * | 10/1987 | Vissing | A01K 91/04 289/17 |
| 4,911,341 | A | * | 3/1990 | Davis | D05B 87/02 223/99 |
| 6,045,016 | A | * | 4/2000 | Okada | D05B 87/00 223/99 |
| 6,830,165 | B2 | * | 12/2004 | Tanaka | D05B 87/00 223/99 |
| 8,020,735 | B2 | * | 9/2011 | Chang | D05B 87/02 223/99 |
| 11,976,399 | B2 | * | 5/2024 | Tanaka | D05B 87/02 |

FOREIGN PATENT DOCUMENTS

| | | | |
|---|---|---|---|
| DE | 0675708 | C | 5/1939 |
| WO | 1993/018220 | A1 | 9/1993 |

OTHER PUBLICATIONS

International Written Opinion for International Application No. PCT/IB2023/050934, mailed May 8, 2023, 9 pages with English machine translation.

* cited by examiner

DEVICE FOR ASSISTING WITH THREADING THE EYE OF A NEEDLE

CROSS-REFERENCE TO RELATED APPLICATIONS

This application is a national phase entry under 35 U.S.C. § 371 of International Patent Application PCT/IB2023/050934, filed Feb. 2, 2023, designating the United States of America and published as International Patent Publication WO 2023/148664 A1 on Aug. 10, 2023, which claims the benefit under Article 8 of the Patent Cooperation Treaty of French Patent Application Serial No. FR2200929, filed Feb. 2, 2022.

TECHNICAL FIELD

The disclosure relates to a device for assisting with threading an eyed needle, which is to say fitting a sewing thread (e.g., a single strand of a sewing thread) through the eye of a sewing needle, also referred to as "eyed needle."

BACKGROUND

Throughout the text, the expressions "sewing needle" and "eyed needle" commonly refer to a sewing implement for driving a sewing needle into the thickness of an article to be sewed. Such a sewing needle has a pointed first longitudinal end designed to pierce the article to be sewed and a substantially flat second longitudinal end transversely pierced by an orifice, referred to as "eye," for threading the sewing thread through, which means that the sewing needle can draw the sewing thread through the article to be sewed.

Devices for making it easier to thread a needle of a sewing machine are known. WO1993/018220, for example, discloses a device comprising a cylindrical body designed to be able to be disposed orthogonally to the axis of elongation of the needle to be threaded, a sleeve that can be moved in translation relative to the cylindrical body, the sleeve being provided with a punch designed to be able to be displaced with the sleeve such that the free end of the punch goes through the eye of the needle so as to draw the thread through the eye. The device of WO1993/018220 is tricky to use. It requires the device and the free end of the punch to be precisely positioned facing the opening of the eye of the needle, such that the displacement of the free end of the punch through the eye also draws the thread through the eye. This device does not make it possible to defer a visual alignment of the device and the opening of the eye.

Embodiments of the disclosure aim to overcome the drawbacks of the device of WO1993/018220.

It is also known practice to use a device commonly referred to as a "needle threader," which is formed of a small metal grip plate supporting a metal wire that is stiff in tension and elastic in flexion, and its flexural stiffness is greater than the flexural stiffness of the sewing thread. The two longitudinal ends of the metal wire are mounted integrally with the small metal plate, the wire being folded on itself in the form of a convex flat quadrilateral (e.g., in the form of a diamond) so as to be able to go through the eye of the sewing needle by way of elastic deformation of the metal wire.

The use of such a "needle threader" actually makes it easier to thread a sewing needle in some cases. However, when the needle is a sewing needle of small diameter in transverse cross-section and when the orifice of the hole itself is small in size, it is still tricky even to introduce the metal wire of the needle threader through the orifice of the eye. The introduction of the metal wire of the needle threader into the eye can notably pose a problem for persons with visual impairments and/or persons subject to uncontrollable shaking.

Embodiments of the disclosure aim to overcome these drawbacks.

BRIEF SUMMARY

Embodiments of the disclosure aim to provide a device for assisting with threading an eyed needle and that makes it possible to overcome at least some of the above-discussed drawbacks.

Embodiments of the disclosure aim to provide such an assistance device that makes it possible to thread an eyed needle with a single sewing thread, e.g., with a single portion of sewing thread.

Embodiments of the disclosure also aim to provide such an assistance device that makes it possible to thread an eyed needle with a single sewing thread of which one of the longitudinal ends is retained in a spool of this sewing thread.

To this end, the disclosure relates to a device for assisting with threading an eyed needle, the eye of the needle being of the type peripherally delimited by a rim extending substantially in a plane, referred to as "opening plane of the eye," the assistance device being characterized in that it comprises a solid body (e.g., a solid ergonomic body) forming:

- a receiving portion, referred to as "eye receiving portion," designed to be able to receive the eye of the needle and hold the needle in position in relation to the solid body, and;
- a passage that goes through the solid body and comprises
  - a portion, referred to as a "guide portion";
  - a first end of the guide portion emerging to the outside of the solid body; and
  - a second end of the guide portion emerging in the eye receiving portion;
- the guide portion forming a funnel for guiding a sewing thread drawn in displacement in the guide portion toward the eye receiving portion, such that the sewing thread passes through the eye of the needle and emerges to the outside of the solid body, owing to this displacement, which means that the needle is threaded.

Throughout the text:

- the term "threading" denotes, in the common meaning of these terms, the act of equipping an eyed needle with a sewing thread (for example, and preferably, with a single sewing thread), such that the sewing thread passes (e.g., once) through the eye of the needle while being held secured to the needle, before and during a sewing operation. The term "threaded" means the state of an eyed needle equipped with a sewing thread passing through the eye of the needle; and
- the term "substantially" indicates, as is conventional, that a structural or functional feature should not be understood as marking an abrupt discontinuity, which would not have a physical meaning, but covers not just this structure or this function but also slight variations of this structure or this function that produce an effect of the same nature, if not of the same degree, in the technical context in question.

The device, according to embodiments of the disclosure, makes it easier to guide the free end of the sewing thread toward the eye of the needle and to thread the needle. The device, according to embodiments of the disclosure, makes it possible to thread a needle with a thread secured to a spool of sewing thread. There is nothing in the device, according to embodiments of the disclosure, that requires the two ends of the sewing thread to be free.

The solid body is referred to as "ergonomic" in that it is dimensioned and shaped so as to be able to be held by an individual in just one hand, such that this individual can hold the sewing thread in the other of their two hands and thread the needle.

The solid body may be made of any material. It may be made of any solid material of natural origin, such as wood, or any synthetic material, notably any composite or non-composite synthetic polymer material. It may be made of at least one thermoplastic polymer material and/or at least one thermosetting polymer material. Advantageously, the material forming the solid body is selected so as to make it possible to manufacture the solid body by molding, notably by thermoforming.

The solid body has a passage that goes through it and emerges on two opposite faces of the solid body.

In some embodiments, the solid body is formed integrally in one piece. However, in other embodiments, there is nothing to preclude the solid body being made of at least two (e.g., two) parts that have complementary shapes and are designed to be able to interact with one another and be reversibly connected to one another (e.g., to each other) so as to form the solid body. In particular, the design of the solid body formed of two complementary parts makes it easier, or even possible, to manufacture the solid body by thermoforming. In these embodiments, the channel for receiving the needle is formed by joining complementary parts to one another.

Advantageously, the guide portion forms a smooth peripheral internal guide wall. The roughness of the peripheral internal wall is designed to limit the friction forces of the sewing thread against the internal wall and to make it easier to guide the sewing thread (e.g., the free end of the sewing thread) in contact with the internal wall without this end of the sewing thread snagging on the internal wall. In some embodiments, the roughness of the peripheral internal wall may range between 0 μm and 50 μm (e.g., between 0 μm and 10 μm).

In some embodiments, the guide portion has a cross section that decreases from its first end emerging to the outside of the solid body to its second end emerging in the eye receiving portion.

In some advantageous embodiments, the guide portion comprises a second frustoconical portion (in the shape of a cone frustum) with a cross section that decreases (e.g., continuously decreases) from its first end emerging to the outside of the body to its end emerging in the eye receiving portion. In some advantageous embodiments, the guide portion has a frustoconical shape exhibiting symmetry of revolution (e.g., about an axis of revolution orthogonal to the opening plane of the eye). However, in some embodiments, there is nothing to preclude the guide portion from having the shape of a conical solid frustum with a polygonal base (e.g., having the shape of a pyramid frustum). In some of these embodiments, the conical solid frustum with a polygonal base has a height (orthogonal to the base of the conical solid frustum and passing through the apex of the conical solid) orthogonal to the opening plane of the eye.

In some advantageous embodiments, the second end of the guide portion has an opening that emerges in the eye receiving portion and is disposed so as to extend facing (e.g., entirely facing) the eye of the needle to be threaded. This makes it easier to guide the end of the sewing thread toward the eye. In some advantageous embodiments, the second end of the guide portion has an opening that emerges in the eye receiving portion and is in the form of a slot extending facing the opening of the eye. There is nothing to preclude the second end of the guide portion from having an oblong opening emerging in and facing the eye receiving portion.

In some embodiments, the solid body forms a channel (e.g., a rectilinear channel) for guiding the eye of the needle in displacement in the solid body up to the eye receiving portion. The guide channel emerges to the outside of the solid body at one of its longitudinal ends and in the eye receiving portion at the other of its longitudinal ends. In some embodiments, there is nothing to preclude the guide channel from having a funnel for admitting the needle into the channel at its longitudinal end emerging to the outside of the solid body. The guide channel has a circular overall shape in any cross-section transverse to the axis of elongation of the guide channel. The guide channel is dimensioned and shaped so as to be able to receive the needle and position the eye of the needle in the eye receiving portion. However, in some embodiments, there is nothing to preclude the guide channel from having two longitudinal grooves, which are radially opposite one another and are designed to be able to each interact with opposite parts of the rim of the eye and guide the eye of the needle in displacement in the guide channel up to the eye receiving portion. In these embodiments, the longitudinal grooves extend into the eye receiving portion, in which they interact so as to be able to hold the eye of the needle in place such that the opening plane of the eye extends facing the second end of the guide portion that emerges in the eye receiving portion.

In some embodiments, the eye receiving portion is provided with a detection member for detecting the position of the eye of the needle in abutment in the eye receiving portion. In some embodiments, the detection member is a sensor coupled to a light-emitting diode that indicates that the eye of the needle is in abutment in the eye receiving portion at the longitudinal end of the channel and indicates that the opening plane of the eye is oriented facing the second emerging opening of the guide portion. Any type of sensor is possible. It may be a pressure sensor, a piezoelectric sensor or the like. There is nothing to preclude the detection member from forming, with the light-emitting diode, a closed electrical circuit owing to the positioning of the needle in the channel, the eye of the needle being in abutment in the eye receiving portion. The detection member comprises a first contactor disposed in the eye receiving portion and forming a stop disposed in the continuation of the guide channel and a second contactor disposed so as to stay in contact with the cylindrical part of the needle when the needle is put in the guide channel. The first and second contactors are connected by an electrical circuit comprising the light-emitting diode and an electrical cell such that the correct positioning of the needle in the guide channel and of the eye in the eye receiving portion closes the electrical circuit, makes the diode light up and indicates that the eye of the needle extends facing the guide portion.

Moreover, in the embodiments in which the guide channel and the eye receiving portion are provided with two radially opposite grooves, the detection member for detecting the position of the eye of the needle in abutment in the eye receiving portion and the light-emitting diode are designed to indicate that the eye of the needle is oriented in the eye receiving portion such that the opening plane of the eye is substantially orthogonal to the axis of elongation of the guide portion and the needle is kept in position in relation to the solid body.

In some embodiments, the guide portion forms a funnel for guiding a free end of the sewing thread that is drawn in displacement in the guide portion toward the eye receiving portion, such that the free end of the sewing thread passes through the eye of the needle and emerges outside the body.

In some other advantageous embodiments, the device for assisting with threading an eyed needle comprises:

a filiform hook extending substantially in a plane and having a longitudinal end point designed to be able to be fitted into the opening of the eye and to progress such that the filiform hook goes through the eye; and means for drawing the hook in displacement between:

a first position, referred to as "retracted position," in which the hook does not extend in the eye receiving portion and the eye of the needle can be put in the eye receiving portion; and a second position, referred to as "threading position," in which the hook extends through the opening of the eye and in which at least part of the hook extends out of the solid body;

the hook being designed to interact with the sewing thread such that the displacement of the means for drawing the hook in displacement from the threading position to the retracted position makes it possible to thread the needle.

In these embodiments, the guide portion is a portion for guiding the hook in displacement between the retracted position and the threading position. In some of these embodiments, the guide portion is also a portion for guiding the hook in displacement between the threading position and the retracted position.

In some embodiments, the hook is formed of at least one metal wire that is stiff in longitudinal tension and elastically deformable transversely in flexion. The hook is designed to be able to elastically deform while it is being displaced as it goes through the eye. The hook is also designed to be able to deform in contact with the guide portion while it is being displaced in the guide portion between the retracted position and the threading position. In some embodiments, the hook is formed by folding the metal wire into at least two successive segments extending substantially in the same plane and forming the longitudinal end point of the hook. The longitudinal end point of the hook is formed by two adjacent consecutive sides of the hook that form an angle (e.g., an acute angle) designed such that the longitudinal end point of the hook can pass through the opening of the eye of the needle and so as to be able to draw the sewing thread through the opening of the eye.

In some embodiments, the hook is an open hook formed of two successive segments of metal wire that are folded on one another, namely a first segment having a longitudinal end supported by the means for drawing the hook and a second segment having a free end, the two segments being shaped so as to be able to interact with the sewing thread such that the hook allows the sewing thread to be snagged by displacement of a loop of the sewing thread wrapped around the first segment up to the longitudinal end point of the hook, which means that the sewing thread is drawn through the eye of the needle by displacement of the means for drawing the hook from the threading position to the retracted position.

In these embodiments, the metal wire forming the open hook has a circular transverse cross section with a diameter ranging between 0.20 mm and 0.40 mm, preferably ranging between 0.25 mm and 0.35 mm, more particularly of about 0.30 mm.

In some other embodiments, the hook is a filiform loop (e.g., a filiform loop made of at least one metal material) closed on itself and extending substantially in a plane and forming a longitudinal end point designed (e.g., dimensioned) to be able to be fitted in the opening of the eye. In some of these embodiments, the hook is formed by folding a portion of metal wire so as to form a convex flat quadrilateral. In some of these embodiments, the hook is formed by folding the portion of metal wire into the shape of a diamond, the two longitudinal ends of the metal wire being mounted integrally with the drawing means. In these embodiments, the hook is designed to be able to pass through the eye of the eyed needle, by elastic deformation of the metal wire.

In some embodiments, the hook (e.g., the filiform loop closed on itself) is made of at least one material that is elastically deformable in flexion between:

a first shaping, referred to as "deformed shaping," of the hook (e.g., of the loop) in which the hook (e.g., the loop) is elastically deformed owing to the passage of the hook (e.g., the loop) through the opening of the eye; and a second shaping, referred to as "threading shaping," of the hook (e.g., of the loop), which is distinct from the deformed configuration and in which the hook (e.g., the loop) is shaped so as to be able to interact with the sewing thread and allow the sewing thread to be snagged;

such that the hook (e.g., the loop) can be elastically brought from the deformed shaping to the threading shaping after the hook (e.g., the loop) has passed through the opening of the eye.

In these embodiments, the metal wire forming the filiform loop has a circular transverse cross section with a diameter ranging between 0.10 mm and 0.20 mm, more particularly of about 0.15 mm. The assistance device according to these embodiments is particularly suitable for threading a needle having a small opening of the eye.

In some advantageous embodiments, the opening slot of the second end of the guide portion has two transversely opposite widenings designed to allow the passage of the filiform hook drawing the sewing thread in displacement between the threading position and the retracted position.

In some embodiments, the means for drawing the hook comprise a trigger, the hook being mounted integrally with the trigger so as to be able to be drawn in displacement by the trigger between the retracted position and the threading position (and between the threading position and the retracted position), along a direction parallel to the axis of elongation of the guide portion and orthogonal to the opening plane of the eye. The trigger is disposed so as to be able to be displaced by a user of the assistance device.

In these embodiments, the assistance device comprises a stiff frame for guiding the trigger and the hook in displacement between the threading position and the retracted position (and between the retracted position and the threading position), the stiff frame being mounted integrally with the solid body. In these embodiments, the trigger has a push-button extending out of the stiff frame and designed to make it possible to displace the hook between the threading position and the retracted position and between the retracted position and the threading position.

In these embodiments, with the hook being in the retracted position, the longitudinal end point of the hook extends in the guide portion between the first and second ends of the guide portion. The longitudinal end point of the hook is guided in displacement in the guide portion up to the second end of the guide portion that emerges in the eye receiving portion and up to the opening of the needle.

In some embodiments, the device for assisting with threading an eyed needle comprises elastic means for returning the trigger and the hook to the retracted position. However, there is nothing to preclude the device for assisting with threading an eyed needle from comprising elastic means for returning the trigger and the hook to the threading position.

In some embodiments, the roughness of the peripheral internal guide wall is low and designed to limit the friction forces of the hook against the internal wall and make it easier to guide the hook in contact with the internal wall and without the hook snagging on the internal wall.

In some embodiments, the solid body has a recess extending from the guide channel and emerging to the outside of the solid body, the recess being designed to allow the passage of two strands of the thread extending upstream and downstream of the eye of the needle, while the needle is being withdrawn from the guide channel.

The disclosure also relates to a method for threading an eyed needle, the eye of the needle being of the type peripherally delimited by a rim extending substantially in a plane, referred to as "opening plane of the eye," which method makes use of a threading assistance device according to embodiments of the disclosure.

The disclosure also relates to a method for threading an eyed needle, the eye of the needle being of the type peripherally delimited by a rim extending substantially in a plane, referred to as "opening plane of the eye," and wherein:

- the eye of the needle is disposed in the eye receiving portion of a device for assisting with threading the needle, such that the second end of the guide portion emerges in the eye receiving portion;
- a sewing thread is introduced into the first end of the guide portion and is drawn in displacement in the guide portion up to the eye receiving portion, the guide portion forming a funnel for guiding the sewing thread, such that the sewing thread goes through the eye of the needle and emerges to the outside of the body, which means that the needle is threaded, and then; and
- the threaded needle is removed from the threading assistance device.

It is not necessary to view the eye of the needle during the threading to thread the eyed needle, and this makes it easier to thread the needle.

In some embodiments of a method for threading a needle, which embodiments make use of a device according to embodiments of the disclosure for assisting with threading a needle, the assistance device comprises a filiform hook of which the free longitudinal end is guided in displacement in the guide portion between the retracted position and the threading position, the filiform hook is put in the threading position in which the filiform hook extends out of the solid body, and then the sewing thread is disposed in relation to the hook such that it is just the displacement of the filiform hook from the threading position to the retracted position that accompanies the threading of the needle. In some embodiments, with the hook being an open hook, the sewing thread is wrapped around the first segment of the open hook and the open hook is brought into the retracted position, which means that the needle is threaded. The threaded needle is withdrawn from the assistance device by a sliding displacement of the needle in the guide channel. Advantageously, the needle is withdrawn from the device in a single movement, by pulling at the same time on the needle (e.g., on the pointed end of the needle) and on one of the two ends of the sewing thread, along the longitudinal axis of the needle (the user pinches the needle and one of the two strands of the sewing thread at the same time and conjointly) so as to cause the other of the two strands of the sewing thread to slide in the opening of the eye of the needle and into the hook, which means that this other strand of the sewing thread is released from the eye of the needle and the hook, which means that the needle is threaded with a single strand of the sewing thread.

In some embodiments of a method for threading a needle, in which a longitudinal end portion of the sewing thread is wound in the form of a spool, the assistance device according to embodiments of the disclosure is held by the user in one of their two hands, referred to as "off-hand" (preferably the left hand if the user is right-handed, and the right hand if the user is left-handed). With the hook being in the retracted position, the user introduces the needle into the guide channel with their hand, referred to as "on-hand," which is opposite to the off-hand, such that the eye of the needle extends facing the second end of the guide portion, and then they displace the trigger and the hook of the assistance device from the retracted position to the threading position. The user then takes up with their on-hand the spool of sewing thread, from which one portion of thread has been unwound, and with their on-hand disposes the portion of thread released such that it is mounted on the hook and such that it is just the displacement of the filiform hook from the threading position to the retracted position that causes the needle to be threaded. All the user then needs to do is take up, in their on-hand holding the spool of thread, the needle and the portion of thread extending between the spool and the eye of the needle by pinching them and withdraw the needle from the guide channel by pulling on the needle and the thread along the longitudinal axis of the guide channel. This pulling causes the free end of the sewing thread to be made to slide through the opening of the eye and the hook, which means that the needle is threaded with a single strand of the sewing thread and is ready to be used.

The disclosure also relates to a method for manufacturing a device for assisting with threading an eyed needle according to embodiments of the disclosure, wherein the solid body is formed by hot molding (e.g., of a solid thermoplastic material).

The disclosure also relates to a device for assisting with threading an eyed needle, to a method for threading an eyed needle, and a method for manufacturing such a threading assistance device, characterized in combination by all or some of the features mentioned above or below. Irrespective of the formal presentation made for them, unless explicitly indicated otherwise, the various features mentioned above or below are not to be considered as being intrinsically or inextricably linked with one another; the disclosure may relate to just one of these structural or functional features or just some of these structural or functional features, or part of just one of these structural or functional features, or any grouping, combination or juxtaposition of all or some of these structural or functional features.

BRIEF DESCRIPTION OF THE DRAWINGS

Other aims, features and advantages of embodiments of the disclosure will become apparent on reading the following description referring to the accompanying figures, which are given solely by way of non-limiting description of some embodiments of the disclosure and in which.

DETAILED DESCRIPTION

Figure 1:
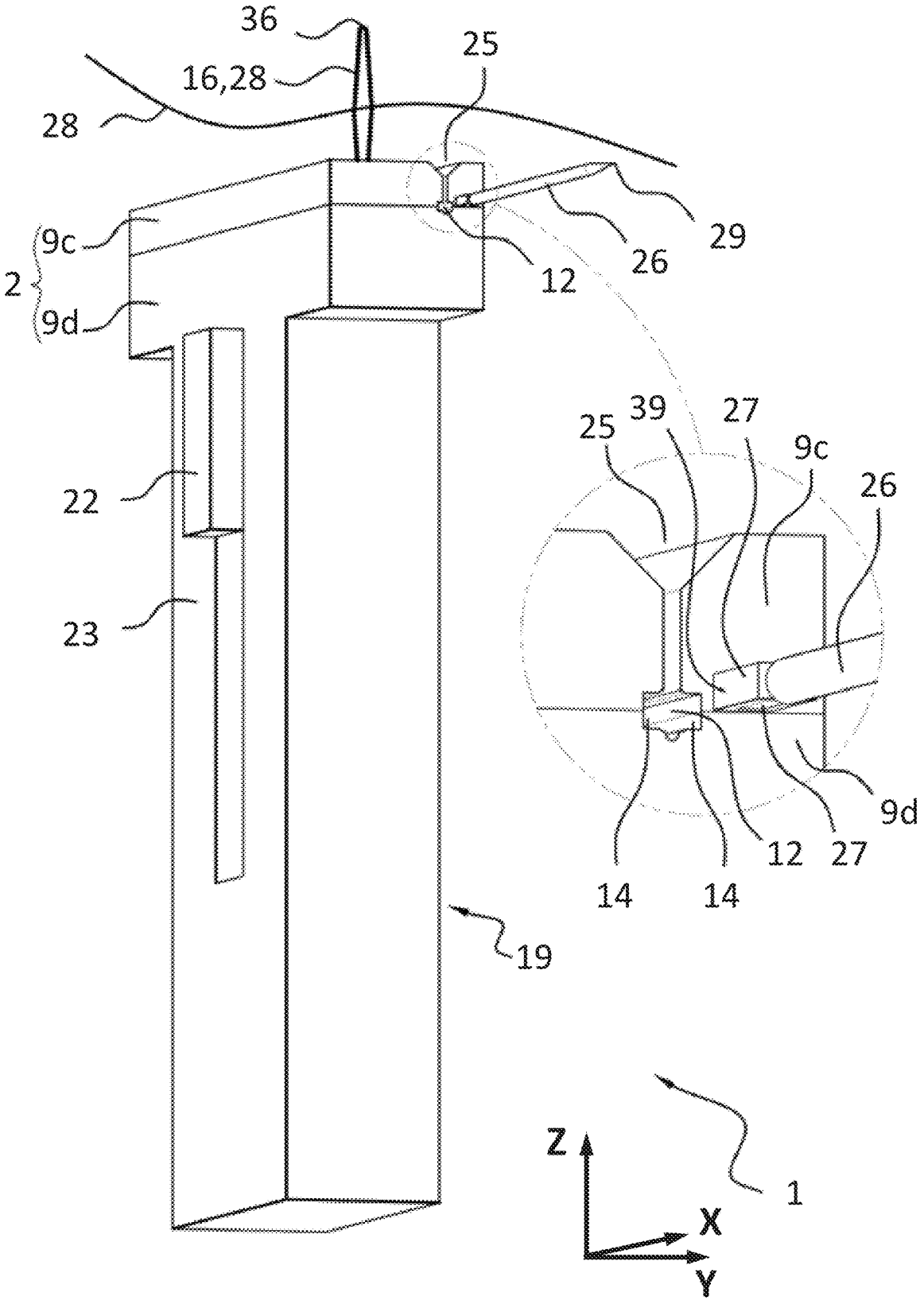
FIG. 1 is a schematic perspective representation of a device for assisting with threading an eyed needle, according to one embodiment, the device comprising a filiform loop.

In the figures of the accompanying drawings, unless explicitly indicated otherwise, the dimensions and proportions of the elements are not necessarily respected for the sake of simplification and clarity of the description. Furthermore, the device for assisting with threading a needle that is shown is configured for use preferably conventionally by a right-handed user, which is to say a user preferentially using their right hand. Such a right-handed user will typically hold the device in their left hand and actuate the trigger with their left thumb, whereas they will perform the trickier operations of manipulating the needle and the thread with their right hand. However, there is nothing to preclude the device from being configured so as to be able to be held in the right hand of a left-handed user, this left-handed user manipulating the needle and the thread with their left hand. The devices for respectively right-handed and left-handed users are mirror images of one another.

The drawings systematically present the device, unless explicitly mentioned otherwise, in an orientation in three-dimensional space like that of the device as seen by the eyes of a user holding it in front of them in their hand or hands, for conventional use. The expression "three-dimensional space" (or 3D space) characterizes the space that surrounds the user, as visually perceived by them, with regard to the width, height and depth. In mathematics, this notion corresponds to the Euclidean geometry in space, according to which the space is identified by three orthogonal axes, whereas a plane is composed of just two dimensions (2D) and is identified only by two of the three orthogonal axes. The three geometric dimensions are, therefore:

the width (left/right), of axis X;

the depth (front/rear), of axis Y; and the height (top/bottom), of axis Z.

The position of any point in the three-dimensional space of axes X, Y and Z is indicated by coordinates measured along each of axes X, Y and Z, respectively, in relation to a defined, generally unique reference point. These coordinates are referred to as:

"abscissa" for the position of the point along the axis X of the width;

"ordinate" for the position of the point along the axis Y of the depth; and

"height" for the position of the point along the axis Z of the height.

For the sake of clarity, the axes X, Y and/or Z are shown in the figures of the drawings where appropriate.

In addition, and unless explicitly mentioned otherwise, the terms and expressions between parentheses below (and all the derived terms, and semantically equivalent expressions) are used in the present disclosure according to the following convention:

"left," "right," "on the left," or "on the right" are used with reference to the direction of the axis X, which is oriented horizontally from left to right in the figures of the drawings; and "front," "rear," "back," and their derivatives, such as "forward," "backward," and the verbs "advance" and "retreat" or equivalent verbs and the derived nouns are used with reference to the direction of the axis Y, which is oriented horizontally from the back to the front in the figures of the drawings; and "on," "underneath," "top," "bottom," and their derivatives, such as "above" and "below" or "on top" and "on the bottom," the terms "upper" and "lower," and the verbs "rise" and "descend" or the equivalent verbs and the derived nouns are used with reference to the direction of the axis Z (or the direction of gravity on Earth), which is oriented vertically from bottom to top in the figures of the drawings.

In addition, the following relative terms, and others where appropriate, are used with mention of the axis X, Y or Z in question, if this does not implicitly follow from the context of the use of these terms in the present disclosure:

"side," "at the side," or "on the side";

"longitudinal," "lateral," or "transverse"; and

"length," "width," "height," or "thickness."

Lastly, from one figure of the drawings to the next, elements that are identical or similar bear the same reference numbers.

In these embodiments, the dimensions of the guide channel 12 (e.g., its length and its diameter in transverse cross section) are selected to allow the displacement of the eye of the needle in the guide channel 12, such that it can reach the eye receiving portion 3. In some embodiments, the guide channel 12 has a circular shape in any transverse cross section. In these embodiments, the diameter in transverse cross section of the guide channel is selected to allow the passage of the eye of the needle. In some other embodiments, the guide channel 12 has a non-circular shape in transverse cross section. This shape may be ovoid, with a larger diameter designed to be able to receive the eye of the needle and guide the needle in longitudinal displacement in the guide channel 12 and bring the eye of the needle into the eye receiving portion 3 such that the opening of the eye extends in a plane orthogonal to the axis 32 of the passage 4 that goes through the solid body 2. This shape may be square, the opening plane of the eye extending along a diagonal of this square cross section and orthogonally to the axis 32 of the passage 4 going through the solid body 2. This shape may be rectangular, the opening plane of the eye extending along the length of this rectangular cross section and orthogonally to the axis 32 of the passage 4 going through the solid body 2. In some other embodiments, in any transverse cross section, the guide channel 12 has a substantially circular shape and has two longitudinal grooves 14, which are radially opposite one another and extend over the entire length of the guide channel 12, the two longitudinal grooves being designed to be able to interact with the rim of the opening of the eye of the needle extending substantially in the opening plane of the eye and to guide the needle up to its threading position.

In the embodiments, the guide portion 5 forms a first funnel 201 delimited laterally by a wall 10 having a cross-section transverse to the axis 32 passing through the passage 4 of the device that decreases between the first end 6 and the second end 7 of the guide portion 5 toward the opening of the eye of the needle 26. This funnel, referred to as "funnel" for taking out the hook, serves to shape the hook in order to make it go through the eye of the needle when the trigger is displaced upward, to make the hook pass from the retracted position 20 to the threading position 21 in which the free end 36 of the hook protrudes out of the casing 9 (formed of the parts 9*c*, 9*d* and 9*e* of the casing 9, which is also referred to as solid body 2 in the present description).

For example, the funnel 201 formed by the guide portion 5 converges and is shaped to emerge in a space 34 extending facing the opening of the eye 27.

One embodiment of a device 1 according to the disclosure for assisting with threading an eyed needle 26 is shown in FIG. 1. This second embodiment of a device according to the disclosure is designed to make it easier to thread a needle with any sewing thread 28, e.g., with a flexible sewing thread 28 having a low stiffness in flexion. The device 1, according to this second embodiment, is formed of a solid body 2 made of at least one polymer material. It may be a thermoplastic polymer material and/or a thermosetting polymer material. Advantageously, the material forming the solid body 2 is selected so as to make it possible to manufacture the solid body 2 by molding, e.g., by hot molding. The device 1 can be moved between:

a first shaping (referred to herein as "deformed shaping") of the filiform loop 16, in which the filiform loop 16 is deformed owing to passing through the opening of the eye of the needle to be threaded; and a second shaping (referred to herein as "threading shaping"), in which the filiform loop 16 is shaped such that the sewing thread 28 can go through it.

In the embodiment shown in FIG. 1, the solid body 2 is formed of two parts 9*c*, 9*d* that have complementary shapes to one another and are designed to be joined to one another by push-fitting, which means that the two parts 9*c*, 9*d* are held joined to one another but are also designed to be able to be separated from one another. The two parts 9*c*, 9*d* forming the solid body 2 are held joined to one another by any joining means that are reversible or irreversible, for example by elastic deformation (also referred to as "clipping"). However, there is nothing to preclude the two parts 9*c*, 9*d* from interacting with one another by reversible push-fitting of complementary surfaces. The two parts 9*c*, 9*d* forming the solid body 2 are joined to one another such that, by being joined together, their respective faces extending facing one another form the passage and the guide portion through which the filiform loop goes. The two parts 9*c*, 9*d* forming the solid body 2 connectingly interact so as to form the guide channel 12 for receiving and guiding the sewing needle 26 in longitudinal displacement in the guide channel 12. There is nothing to preclude the two parts 9*c*, 9*d* forming the solid body 2 from being able to be separated from one another so as to release the needle 26 after it has been threaded. There is nothing to preclude the two parts 9*a*, 9*b* forming the solid body 2 from not being separable and the threaded needle from being able to be removed from the solid body 2 by longitudinal displacement of the threaded needle in the guide channel 12, the sewing thread going through the opening 38 of the eye 27 of the needle being guided along the recess 25. In this embodiment, the two parts 9*c*, 9*d* forming the solid body 2 also connectingly interact so as to form the passage going through the solid body 2 and the guide portion, which are designed to be able to guide the displacement of a longitudinal end 36 of the filiform loop 16 such that it goes through the opening of the eye of the needle.

Figure 4:
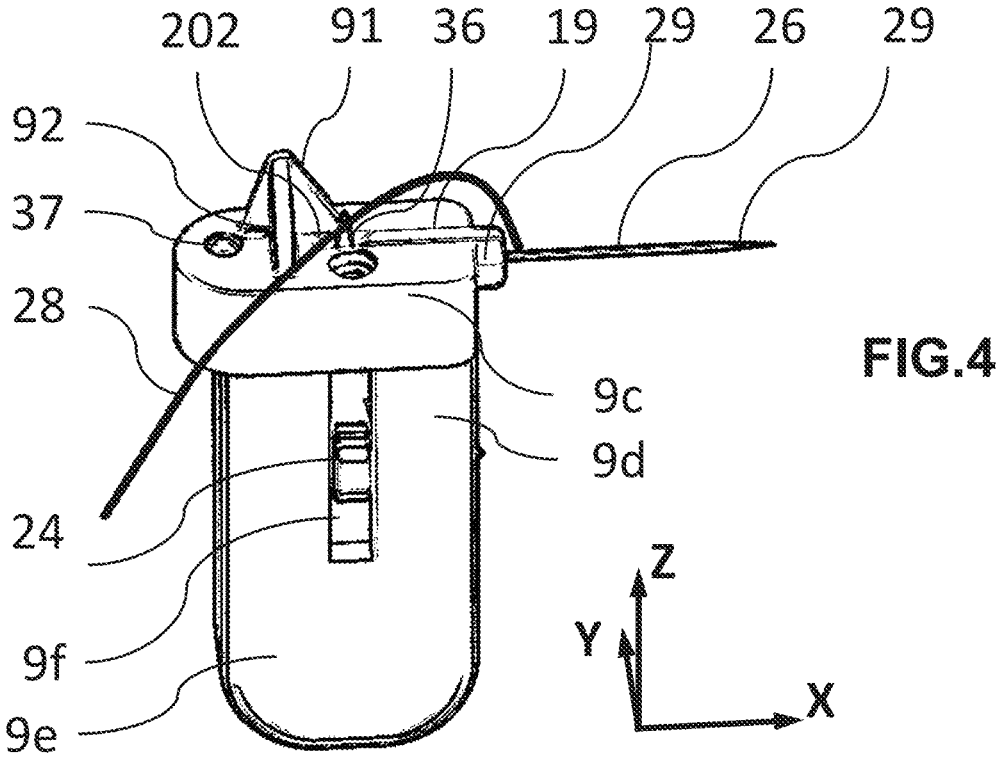
FIG. 4 shows the device of FIG. 3, when the filiform hook is in the retracted position.
Figure 5:
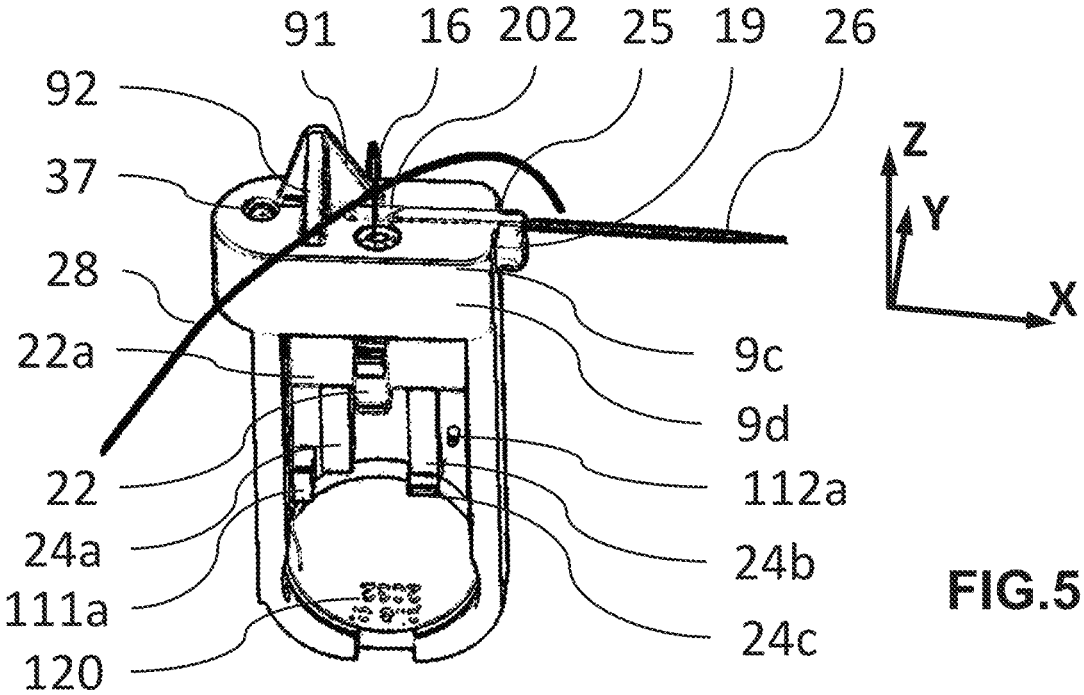
FIG. 5 shows a variant of the device from FIG. 4, in which the filiform hook is an open loop, in the same threading position as the hook of FIG. 4.

The assistance device 1, according to the second embodiment of the disclosure shown in FIG. 1, comprises means (e.g., flange) 19 for drawing the filiform loop 16 in displacement between a first position, referred to as "retracted position 20," of the filiform loop 16 in which the filiform loop 16 extends set back from the eye receiving portion 3 and does not go through the eye 27 of the needle 26 and a second position, referred to as "threading position 21," of the filiform loop 16 in which the filiform loop 16 extends through the opening of the eye and in which the filiform loop 16 is in the threading shaping 18 and at least part of the filiform loop 16 extends out of the solid body 2. In the embodiment shown in FIG. 4, the means (e.g., flange) 19 for drawing the filiform loop 16 comprise a stiff frame 23 and a trigger 22 mounted slidingly in relation to the frame 23, the trigger 22 carrying the filiform loop. The frame 23 has two grooves 24*a* and 24*b* for guiding the trigger 22 and the filiform loop 16 in displacement between the retracted position 20 and the threading position 21.

The solid body 2 has a recess 25 extending from the guide channel 12 and emerging over its entire length to the outside of the solid body 2. The recess 25 is designed to allow the passage of the two longitudinal portions of the thread threaded in the needle 26 and extending upstream and downstream of the eye 27 of the needle 26 when the threaded needle is being withdrawn from the assistance device 1 by sliding in the guide channel 12.

The guide channel 12 for guiding the needle 26 emerges at one of its longitudinal ends to the outside of the solid body 2 and at the other of its longitudinal ends in the eye receiving portion 3 for receiving the eye of the needle 26 such that the eye of the needle is guided in longitudinal displacement along the guide channel 12. The guide channel 12 in any transverse cross section has a shape designed to be able to receive and interact with the eye 27 of the needle 26. It may have a circular overall shape in any transverse cross section. In the embodiment shown, in any transverse cross section it has a circular overall shape intended to interact with the cylindrical part of the needle 26, and two grooves 14 extending radially set back from the outside of the guide channel 12, diametrically opposite one another, and longitudinally over the entire length of the guide channel. The grooves 14 are dimensioned (e.g., in width and in depth) to be able to interact with at least part of the rim 39 of the opening 38 of the eye and to guide the eye 27 of the needle 26 in displacement in the guide channel 12 up to the eye receiving portion 3. In this embodiment, the eye 27 of the needle is positioned in the eye receiving portion 3 such that the rim 39 of the opening 38 of the eye 27 extends in a plane perpendicular to the axis 32 passing through the passage 4 and the guide portion 5.

Figure 2:
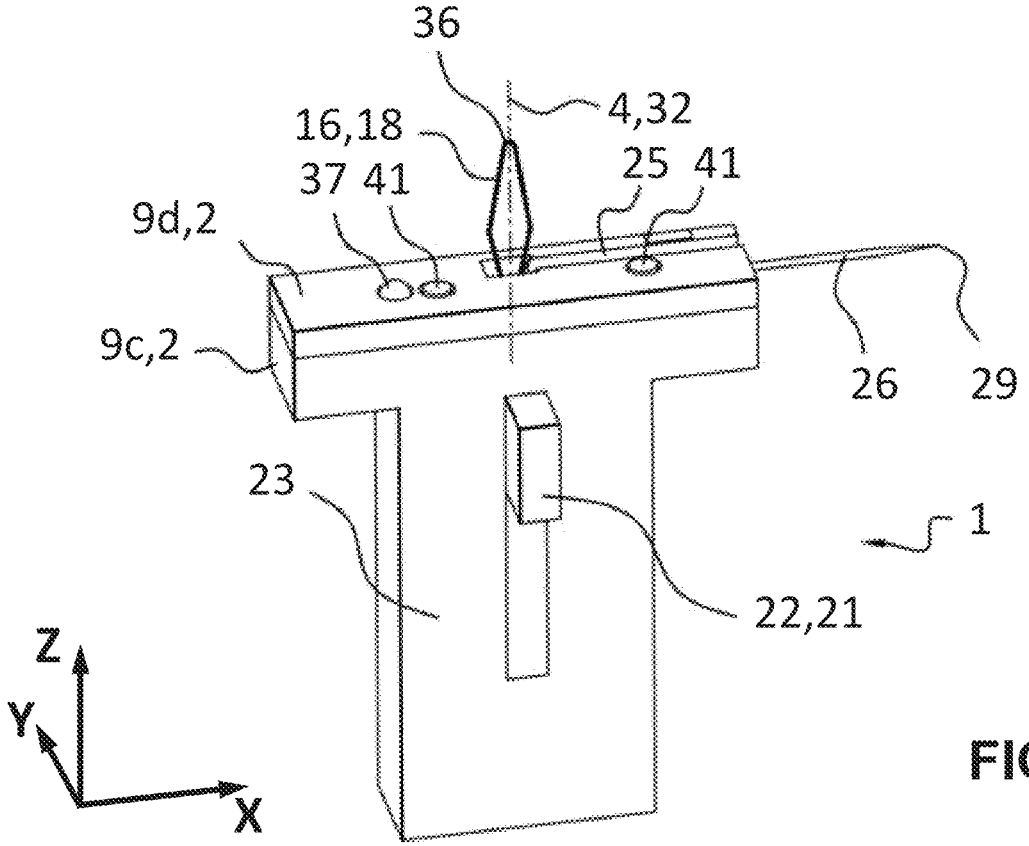
FIG. 2 is a perspective representation of a device for assisting with threading an eyed needle, according to another embodiment.
Figure 3:
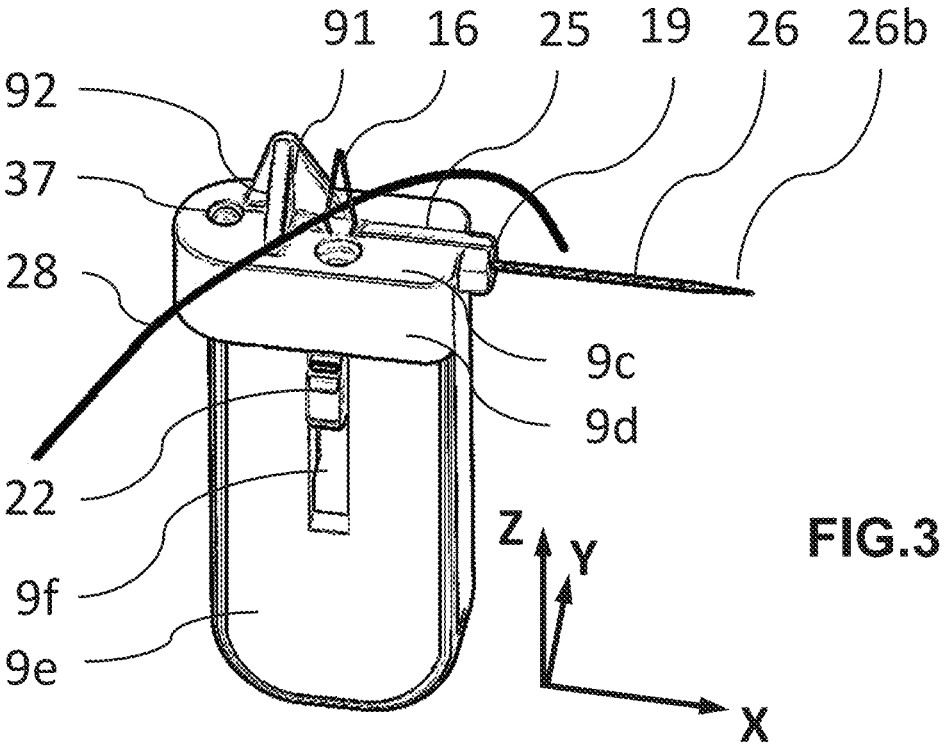
FIG. 3 is a view of a variant of the embodiment of FIG. 2, which illustrates preferred embodiments of the casing of the device, and in which the filiform hook is a closed loop in the threading position.

A cross-sectional view of a second embodiment of a device 1, according to the disclosure, is shown in FIG. 2 in a first position, referred to as "retracted position 20," of the filiform loop 16 in which the trigger 22 is pushed up (i.e., moved away from the guide portion 5), the filiform loop 16 extends set back from the eye receiving portion 3 and does not go through the eye 27 of the needle 26. In the retracted position 20, the free end 36 of the filiform loop 16 extends in the guide channel 12. The guidance of the filiform loop 16 between the retracted position 20 and the threading position 21 is improved. In the retracted position 20 of the filiform loop 16, the needle 26 can be introduced into the guide channel 12 such that the longitudinal end of the eye 27 of the needle comes into abutment in the eye receiving portion 3 and that the opening plane of the eye 27 is orthogonal to the axis 32 passing through the passage 4 and the guide portion 5. From this retracted position 20 of the filiform loop 16, the latter can be drawn in displacement by actuation of the trigger 22 along the axis 32 passing through the passage, which means that the free end 36 of the filiform loop 16 interacts with the wall 10 of the guide portion 5 so as to be guided toward the opening of the eye 27 and go through it, without it being necessary for the user to provide visual assistance at the opening of the eye and/or the free end 36 of the filiform loop 16. Going through in this way means the filiform loop 16 temporarily takes on the deformed shaping, in which the filiform loop 16 is deformed owing to the stresses linked to its passage through the opening of the eye 27 of the needle 26 to be threaded, and elastically returns to the threading shaping 18, in which the filiform loop 16 is shaped such that the sewing thread 28 can go through it, when the filiform loop 16 is in the threading position 21.

Figure 16:
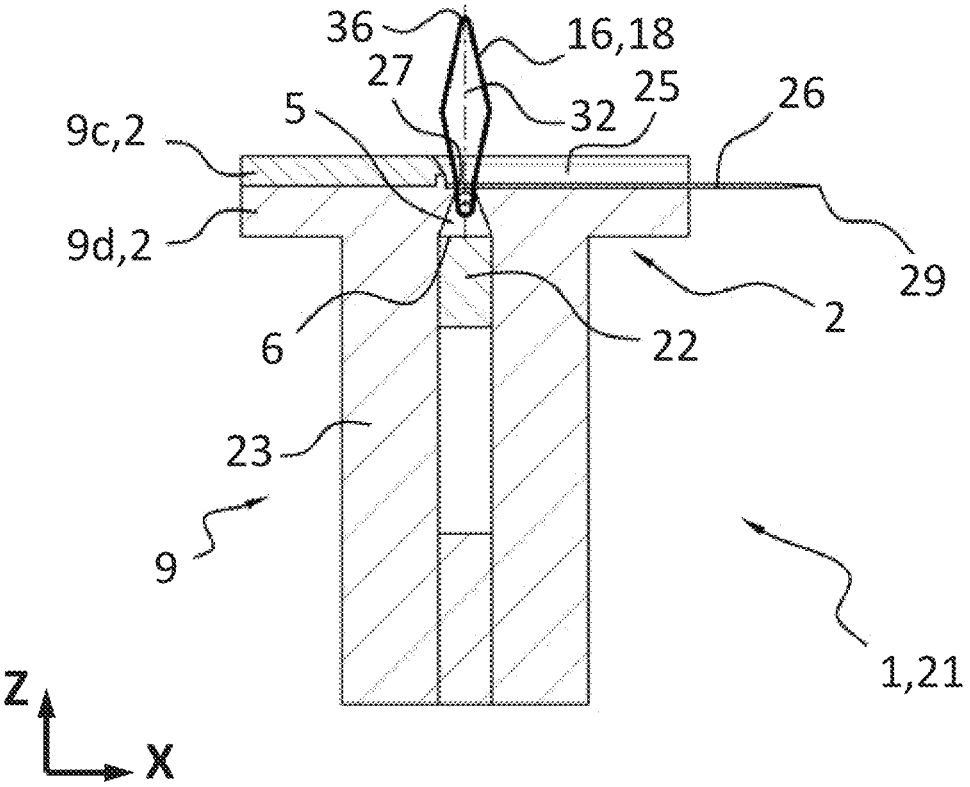
FIG. 16 is a cross-sectional representation of the embodiment of the device shown in FIG. 4, the filiform loop being in a threading position.
Figure 17:
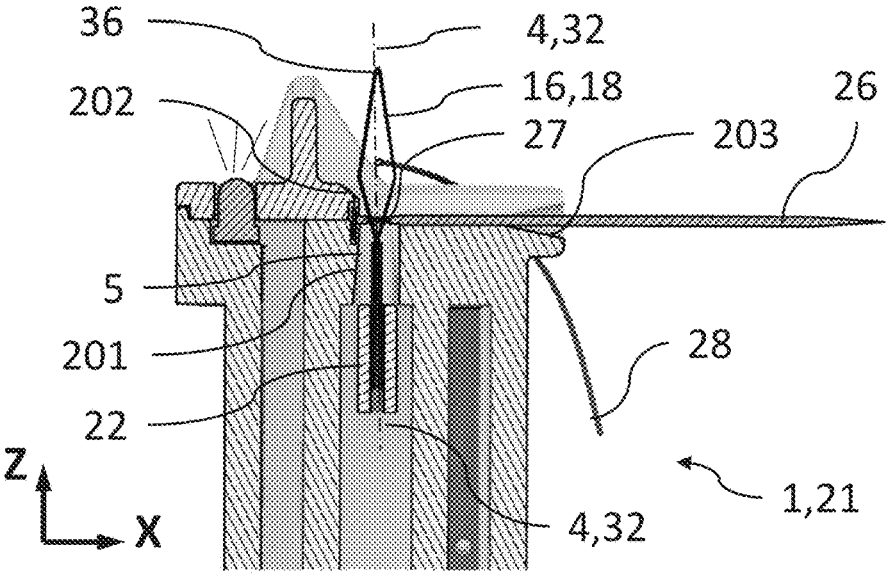
FIG. 17 is a cross-sectional view of the top of the device from FIG. 3 in the cross-sectional plane A-A from FIG. 12, in which the hook is a closed loop that is in the threading position, essentially out of the casing of the device.
Figure 18:
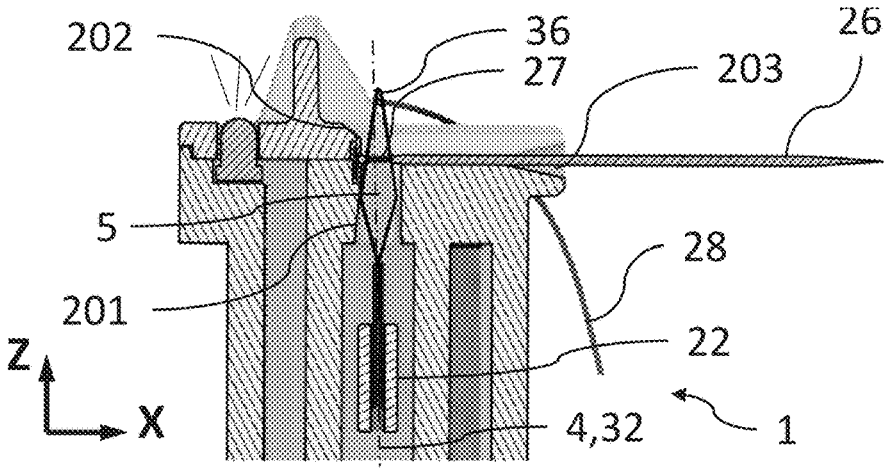
FIG. 18 is another cross-sectional view of the top of the device from FIG. 3 in the cross-sectional plane A-A of FIG. 12, similar to the view of FIG. 17, but in which the hook is in an intermediate position between the threading position and the retracted position, partially back in the casing but still with its free end point outside the casing of the device, as illustrated in FIG. 4.
Figure 19:
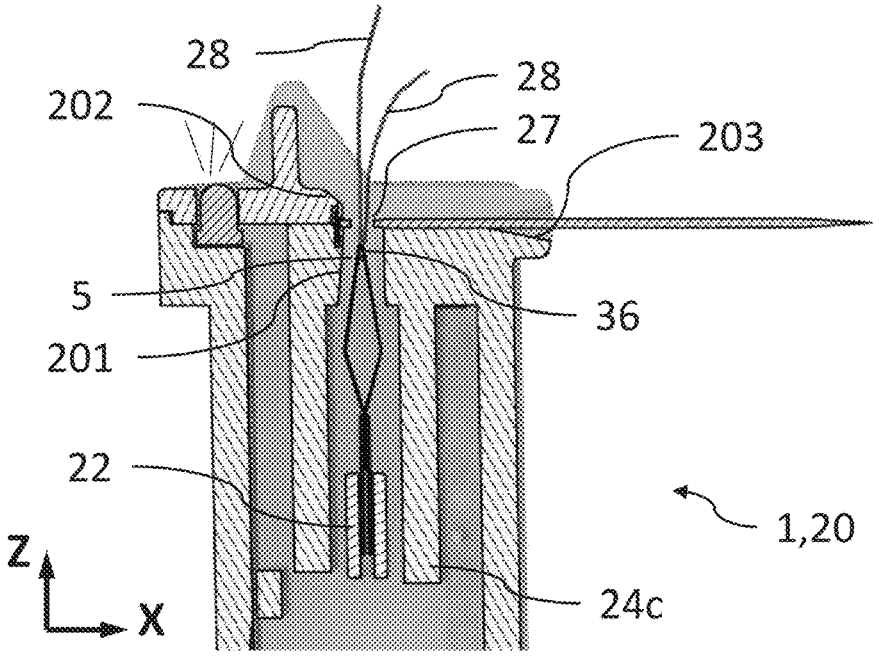
FIG. 19 is another cross-sectional view of the top of the device of FIG. 3 in the cross-sectional plane A-A from FIG. 12, similar to the view of FIG. 17 and to the view of FIG. 18, but in which the hook is in the retracted position, entirely back in the casing of the device.
Figure 20:
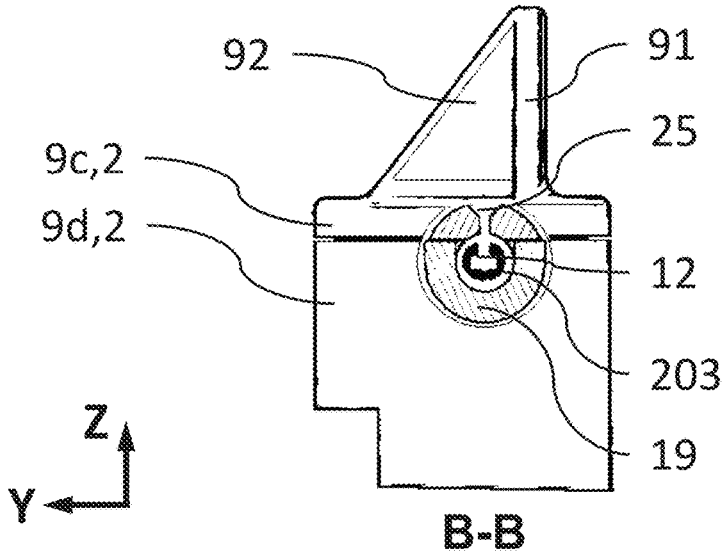
FIG. 20 is a view from the right-hand side of the top of the device, in the cross-sectional plane B-B of FIG. 12.
Figure 21:
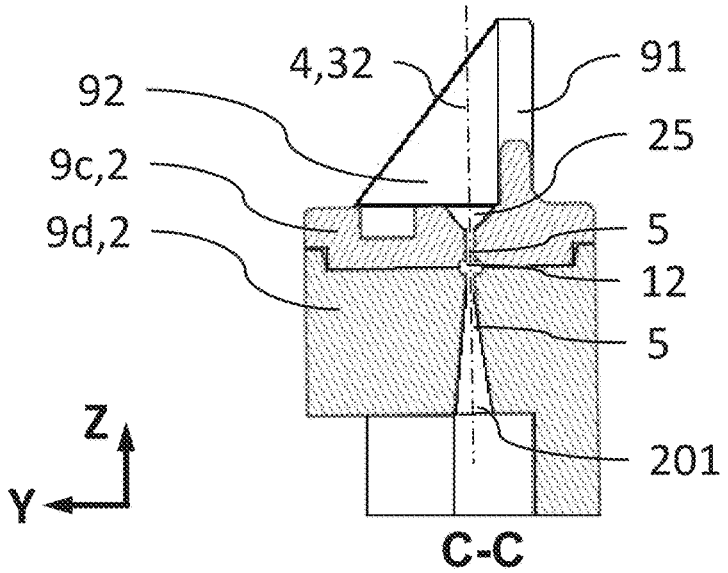
FIG. 21 is a view from the right-hand side of the top of the device, in the cross-sectional plane C-C of FIG. 12.
Figure 22:
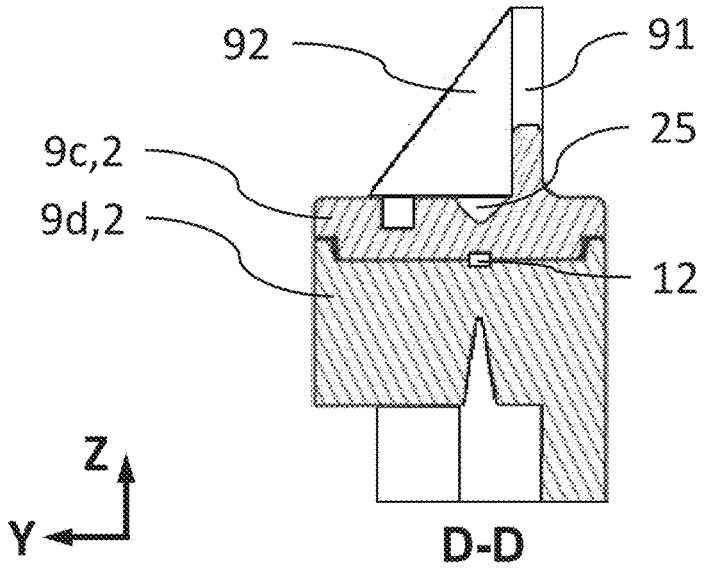
FIG. 22 is a view from the right-hand side of the top of the device, in the cross-sectional plane D-D of FIG. 12.

A schematic, cross-sectional view of a device 1, according to the disclosure, is shown in FIG. 16 in the threading position 21 of the filiform loop 16, in which the trigger 22 is close to the guide portion 5, such that the free end of the filiform loop 16 extends out of the solid body of the device 2 (upward), and such that the other end of the filiform loop 16 that is integral with the trigger 22 still extends through the eye 27 of the needle 26 as long as the needle is disposed in abutment in the eye receiving portion 3. After the free end of the filiform loop 16 has gone through the eye of the needle 26 and arrived in the threading position 21 as shown in the figure, the filiform loop 16 is elastically returned to the threading shaping 18, in which the filiform loop 16 forms an opening for a portion of sewing thread 28 to go through as shown in FIG. 1, from the deformed shaping. In this threading shaping 18, the person using the assistance device according to the disclosure can introduce one of the longitudinal ends of the portion of sewing thread 28 into the passage opening formed by the filiform loop 16. The user can then operate the trigger 22 downward to return the filiform loop 16 to the retracted position 20, which means that the filiform loop 16 returns to its deformed shaping so as to go through the opening of the eye 27 toward the inside of the device until it is in the retracted position 20 again and frees up the opening of the eye, by drawing with it the two strands of sewing thread 28 also through the opening of the eye of the needle 26, which means that the needle is threaded. It will be noted that, advantageously, it is then the eye of the needle itself and the internal wall of the guide portion for guiding the loop that, essentially, cause the deformation of the filiform loop 16 that allows it to go through the eye 27. The funnel 201 for putting the free end back in serves only to guide the free end of the filiform loop 16 in order for it to fit in the passage 4 correctly.

Owing to the eye of the needle 26 being freed up by the filiform hook 16 in the retracted position 20 of the needle 26 out of the assistance device 1, it is necessary to keep one of the two strands of thread 28 secured to the needle 26 and to free up the filiform loop 16 by sliding the other of the two strands of thread 28, which means that the thread 28 comes away from the filiform loop 16.

A first variant of the assistance device 1 according to the disclosure is shown in FIG. 2, in which the filiform loop 16 is in the threading position 21. In this variant, the part 9*c* forming the solid body 2 with the part 9*d* is provided with pins 41 designed to be able to interact with bores formed in the part 9*d* and secure the parts 9*c* and 9*d* so as to form the solid body 2. The solid body 2 is equipped with an alert device 37 (e.g., a photoluminescent diode) connected to a sensor 40 designed to be able to detect the correct positioning of the eye 27 of the needle 26 in the eye receiving portion 3. As a result, the correct placement of the needle 26 in the guide channel 12 and the eye 27 in the eye receiving portion 3 is detected by the sensor, which activates the alert device owing to this detection. The user is thus alerted to the correct positioning of the needle 26 in the channel and the eye 27 in the eye receiving portion, such that the filiform loop 16 can be brought from the retracted position 20 to the threading position 21, which means that the filiform loop 16 can be threaded. After the filiform loop 16 has been threaded, bringing the filiform loop 16 into the retracted position 20 makes it possible to release the threaded needle.

Figure 10:
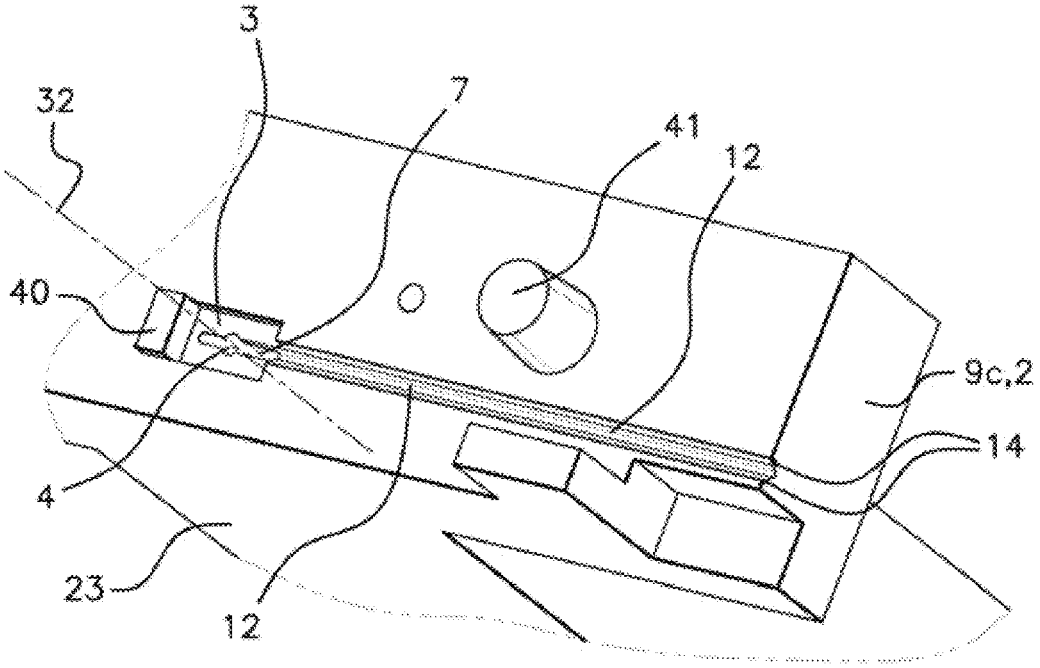
FIG. 10 is a schematic perspective representation of a first part of the device for assisting with threading an eyed needle, according to the embodiment of the disclosure shown in FIG. 2.
Figure 11:
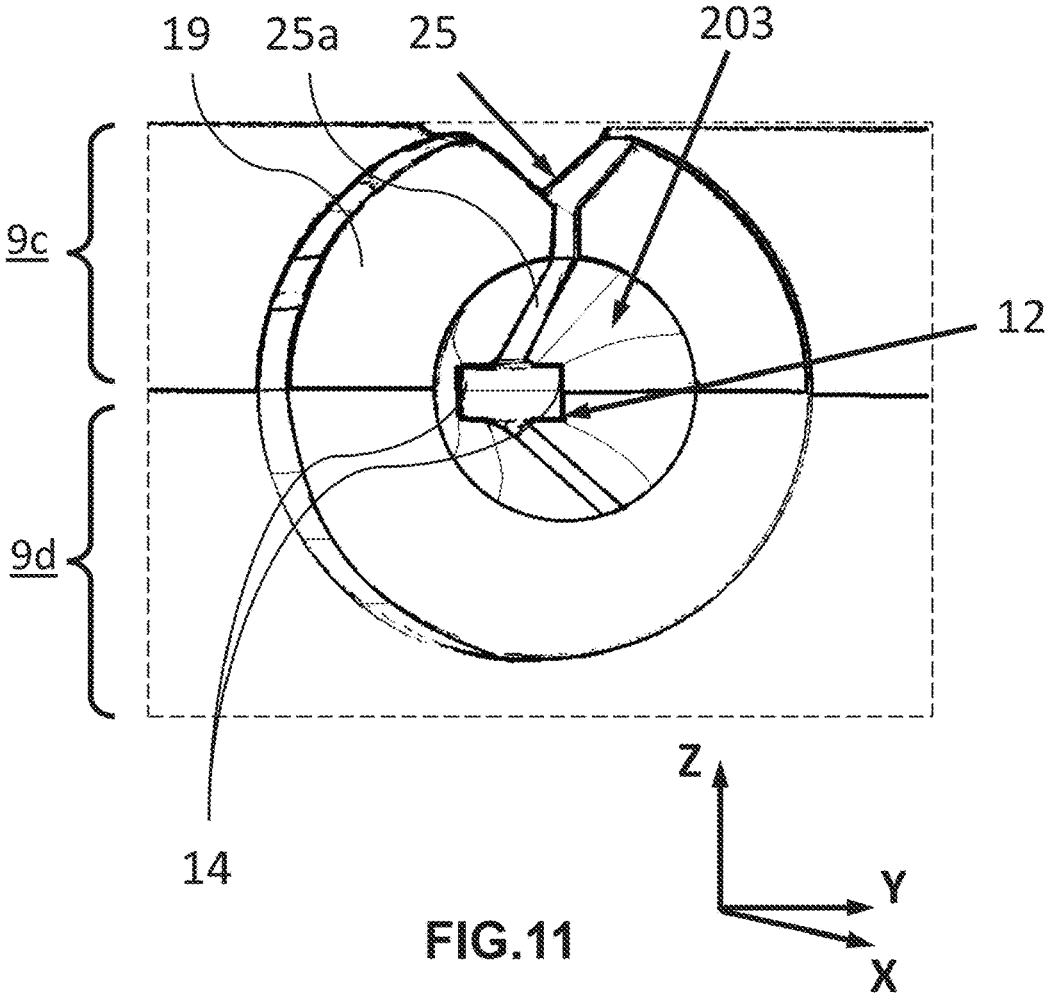
FIG. 11 shows a view, from the right-hand side of the device, of a funnel for inserting the needle into the device, according to some embodiments of the disclosure.
Figure 12:
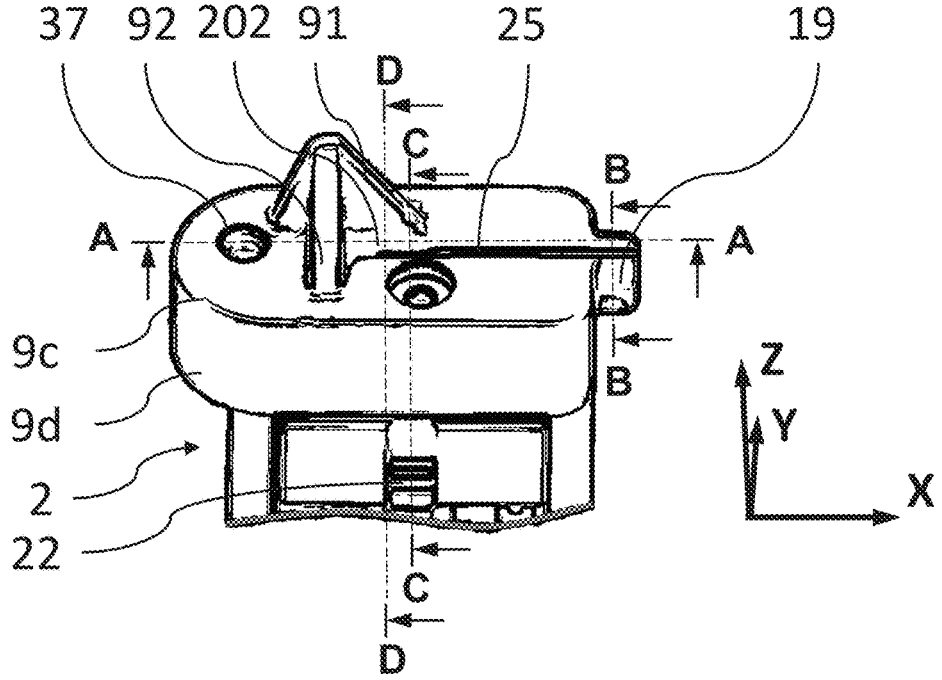
FIG. 12 shows a front view, slightly from above, of the top of the device of FIG. 5 with the front closure cap of the casing removed.
Figure 13:
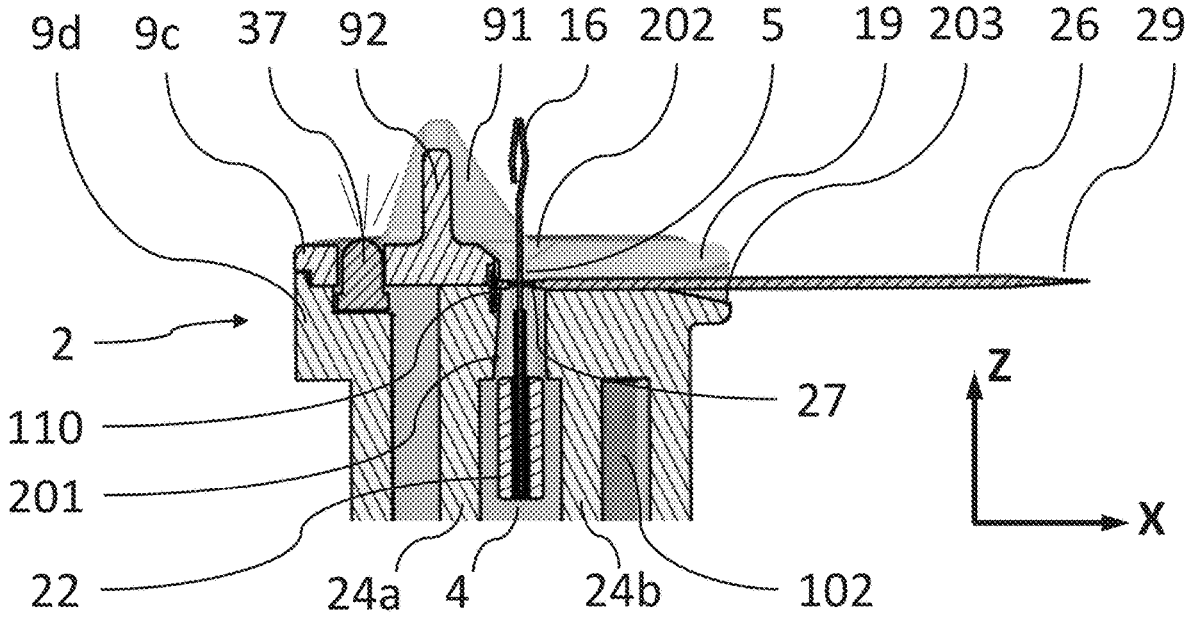
FIG. 13 is a cross-sectional view of the top of the device from FIG. 5, in the cross-sectional plane A-A of FIG. 12.
Figure 14:
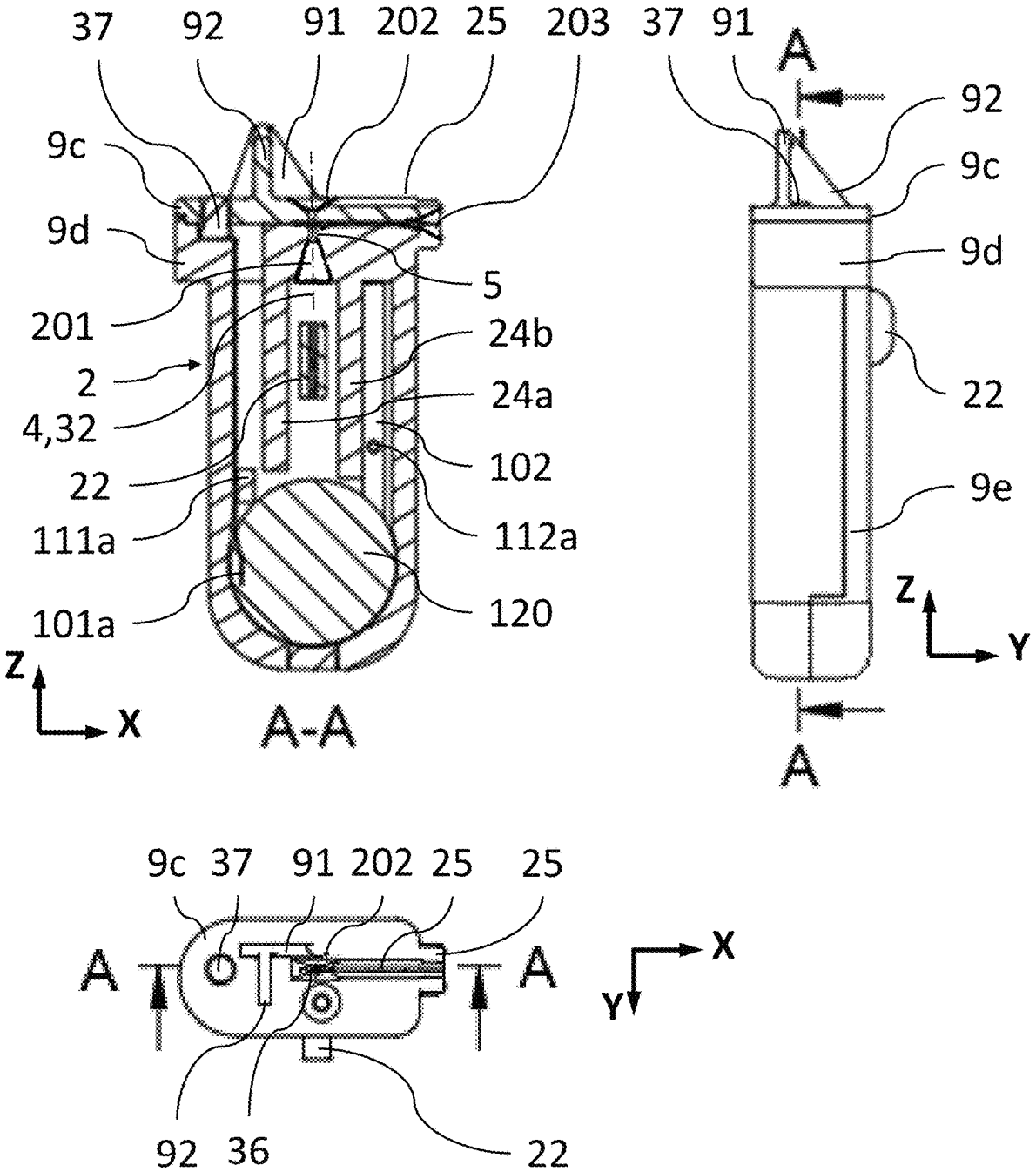
FIG. 14 shows a cross-sectional view of the device from FIG. 5, also in the cross-sectional plane A-A of FIG. 12, in which the hook is absent in order to better show the passage for the hook, its guide portion, and the funnel for taking out the hook and the funnel for putting the hook back in; this figure also shows a view from the left-hand side, and a view from above, of the device of FIG. 5 in which the hook has been removed, like for the cross-sectional view also shown in this FIG. 14.
Figure 15:
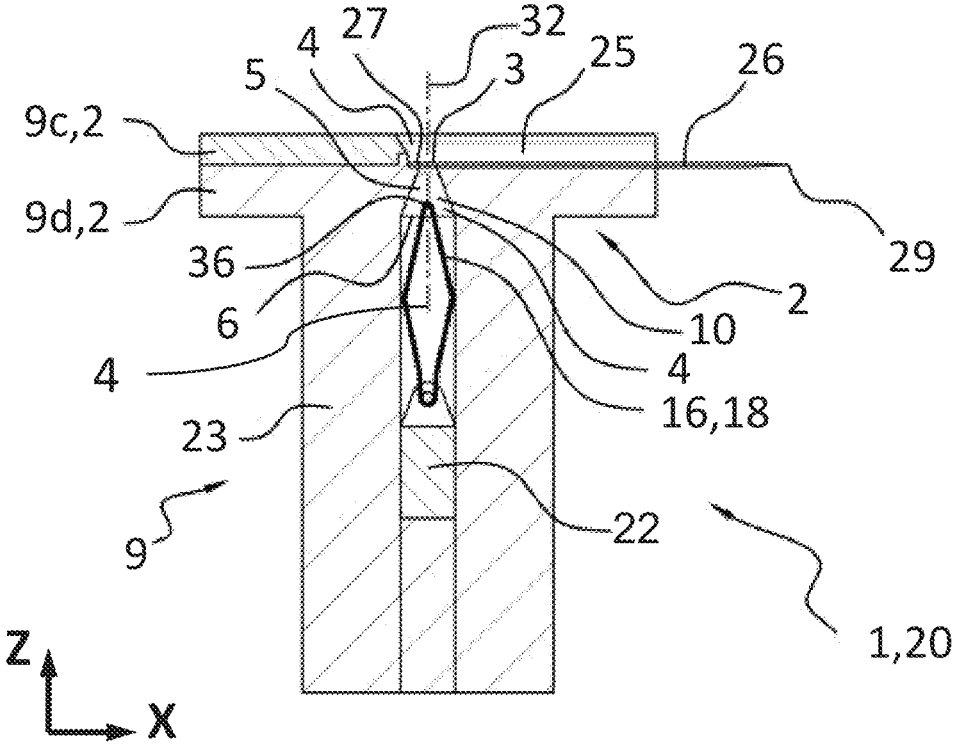
FIG. 15 is a cross-sectional representation of the embodiment of the device shown in FIG. 1, the filiform loop being in a retracted position.

One detail of the variant of the second embodiment of an assistance device 1, according to the disclosure, is shown in FIG. 10, which shows the part 9*d* of the casing in a top view. In this figure, the filiform loop 16 is in the retracted position 20 (and is, therefore, not visible in FIG. 10) and the part 9*c* of the solid body 2 has been removed. The part 9*c* of the solid body 2 forms a first part of the guide channel 12, the other part of the guide channel being formed in the part 9*c* (not shown). The part 9*d* of the solid body 2 also forms a part of the eye receiving portion 3 and has a passage 4 designed to be able to interact with the second end 7 of the guide portion 5 for guiding the hook 16 (also referred to herein as "filiform loop 16" or "filiform hook 16"). A sensor 40 is disposed in the eye receiving portion 3, opposite the entrance to the guide channel 12 in the eye receiving portion 3. The sensor may be of any suitable type. It may be, for example, a piezoelectric sensor designed to generate an electrical signal as a result of a pressure exerted by the eye 27 of the needle on the sensor 40.

Some alternative embodiments to this sensor 40 are illustrated, e.g., in FIGS. 27 to 30. In these embodiments, the device comprises a detector for detecting the correct positioning of the needle 26 in abutment in the bottom of the guide channel 12. Correct positioning of the needle is understood to mean a disposition of the needle with the opening of the eye 27 in line with the axis 32 of the passage 4 for the hook 16, and with the opening of the eye correctly oriented perpendicularly to axis 32 (which coincides with the vertical axis Z in the figures). The referencing of the needle in accordance with this positioning is obtained by inserting the needle 26, the eye 27 first, into the guide channel 12 from right to left, and by bringing it into abutment with the bottom of the channel.

Figure 27:
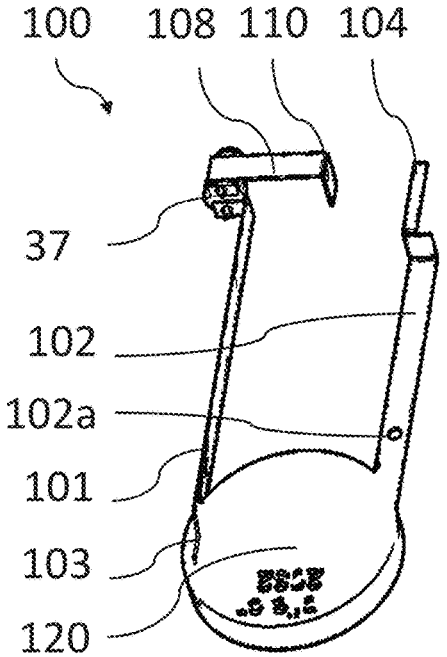
FIG. 27 shows, on its own, a device for detecting the correct positioning of the needle to be threaded, in the eye receiving portion of the device, the position making it possible to thread the needle, according to some embodiments of the disclosure.
Figure 28:
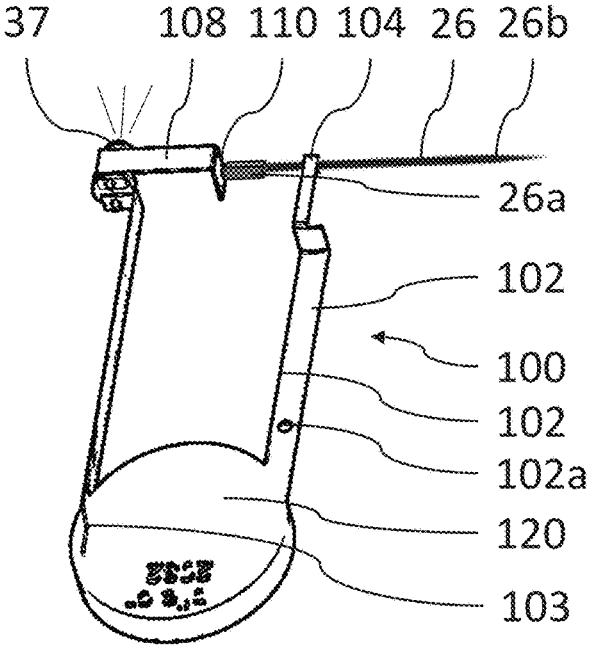
FIG. 28 shows the detection device from FIG. 27 in the presence of a correctly inserted needle, in abutment in the device, in the correct position for threading the needle.

As shown in FIGS. 27 and 28, the detection device 100 comprises a first conductive arm 101, a second conductive arm 102 and a third conductive arm 108. In operating conditions, the arm 101 and the arm 102 are connected to each other via a cell 120. To this end, a free end of the arm 101 comprises a tab 103 that is offset toward the front of the device so as to be in front of a first face of the cell 120, in contact with the cell. The arm 102 also comprises an extension 106 that extends transversely (along the axis Y) in relation to the longitudinal axis of the arm 102 (which coincides with the axis Z) and comes into elastic contact with the other face of the cell 120, at the back of the cell, by way of its end substantially in the center of the receiving portion 2*a* formed in the frame of the casing 9 and, more particularly, of the part 9*d* of the casing.

At the other end of the arm 101, opposite the tab 103, there is connected a first terminal of a light-emitting diode 37, the other terminal of which is connected to one end of the conductive arm 108. Lastly, the arm 102 comprises another end 104 opposite the one from which the transverse extension 106 extends.

As shown in FIG. 28, when the needle 26 is in abutment in the guide channel 12, it closes the electrical circuit thus formed by conductively connecting the end 104 of the arm 102 and the other end 110 of the arm 108. Since the needle 26 is made of metal, generally steel, it is effectively a conductor of electrical current.

Figure 6:
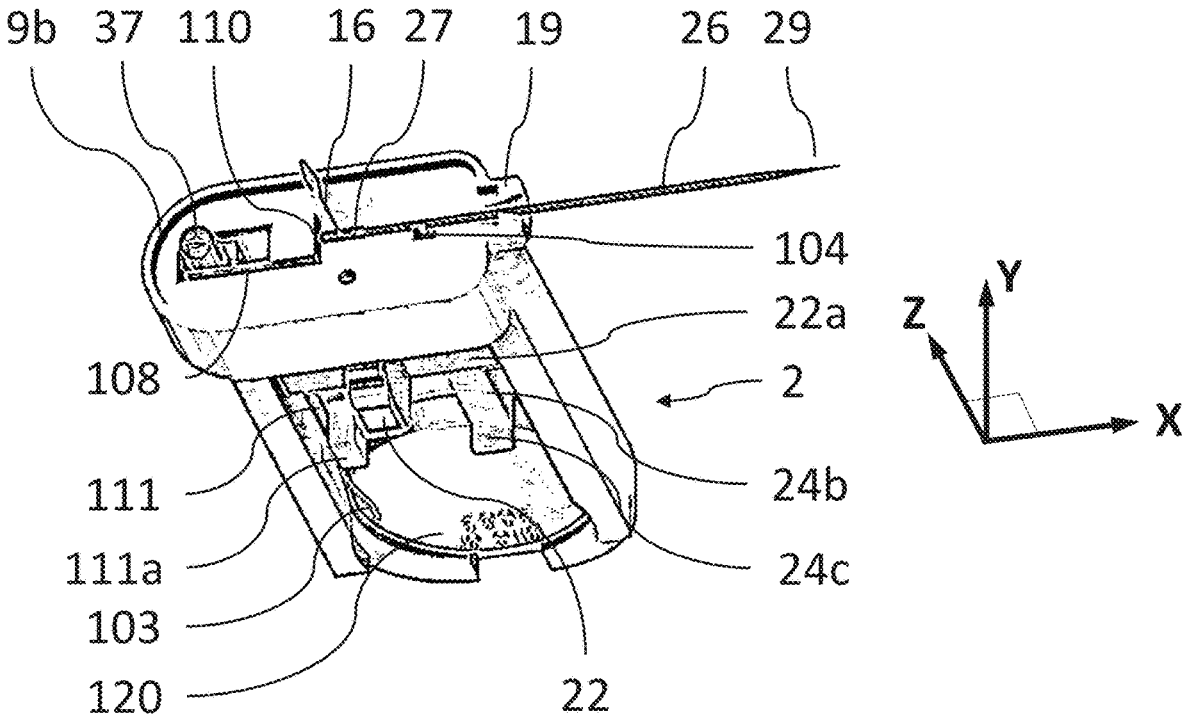
FIG. 6 shows, slightly from above, the device of FIG. 5, of which an upper element of the casing and a front closure cap have been removed from the rest of the casing.
Figure 7:
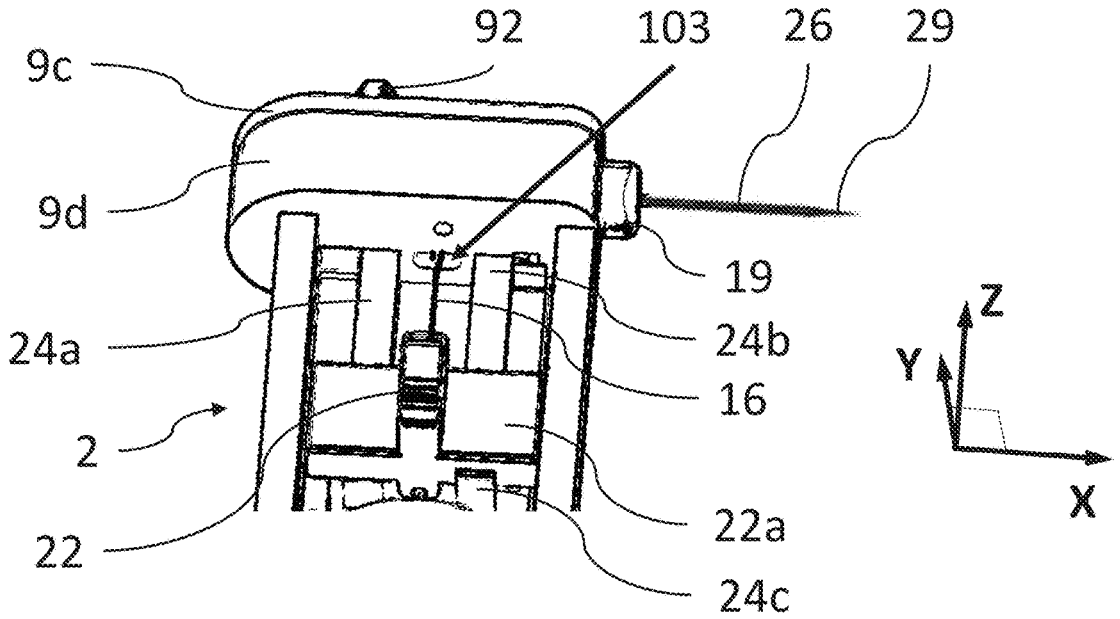
FIG. 7 is a partial view, slightly from below, of the device of FIG. 5, of which the front closure cap has been removed from the rest of the casing.
Figure 8:
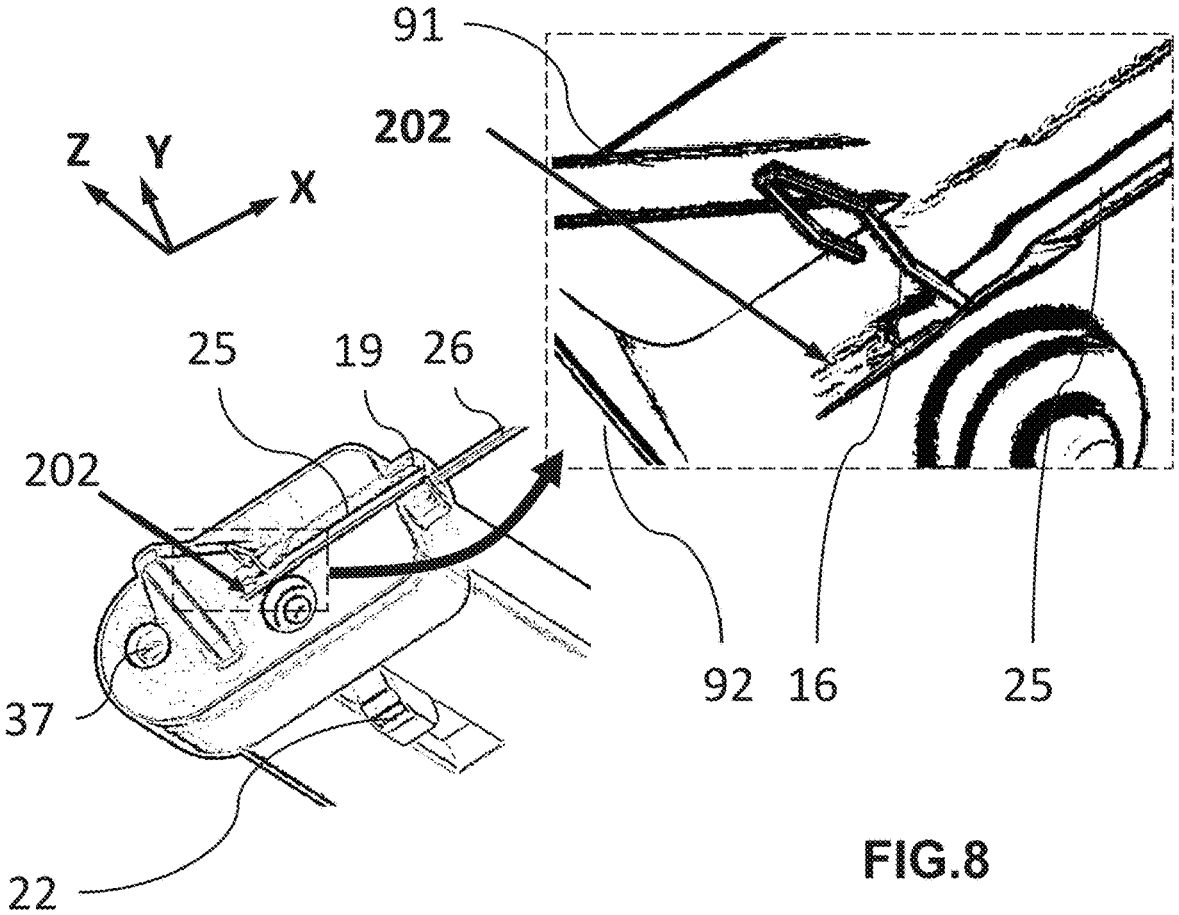
FIG. 8 shows, slightly from above, the device of FIG. 5 with the upper element of the casing in place, and illustrates a funnel for putting the hook back into the body of the device, according to some embodiments of the disclosure.
Figure 9:
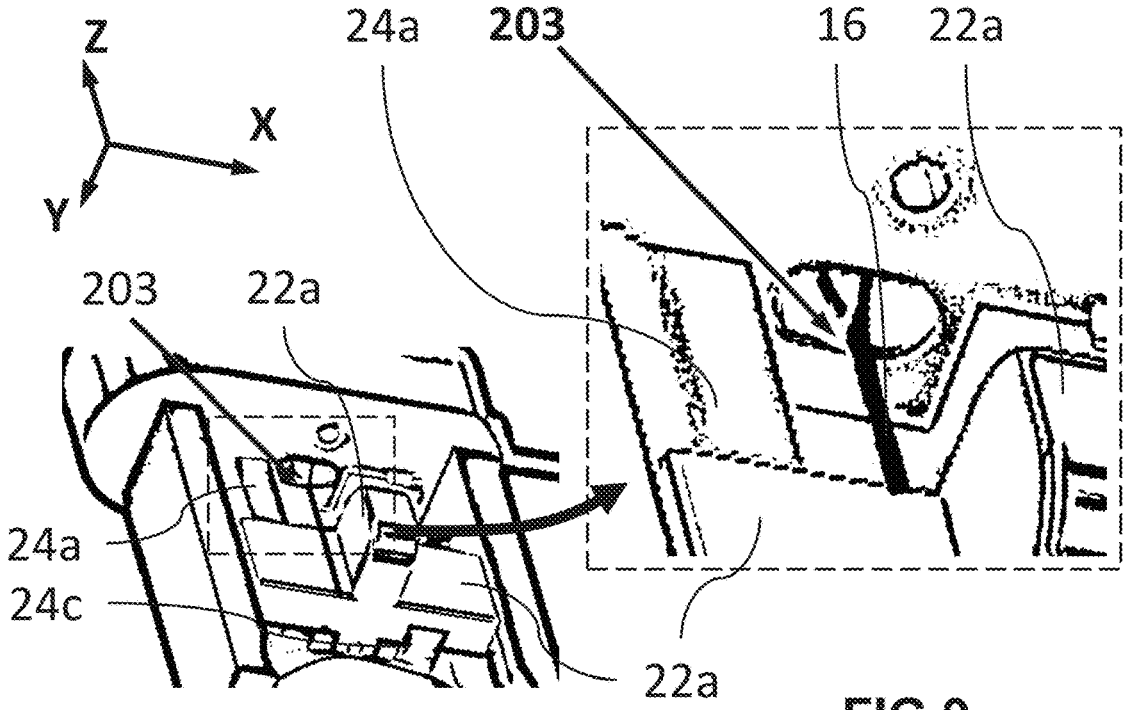
FIG. 9 shows, slightly from below, the device of FIG. 5 with the front closure cap of the casing removed, and illustrates a funnel for taking the hook out of the device, according to some embodiments of the disclosure.
Figure 29:
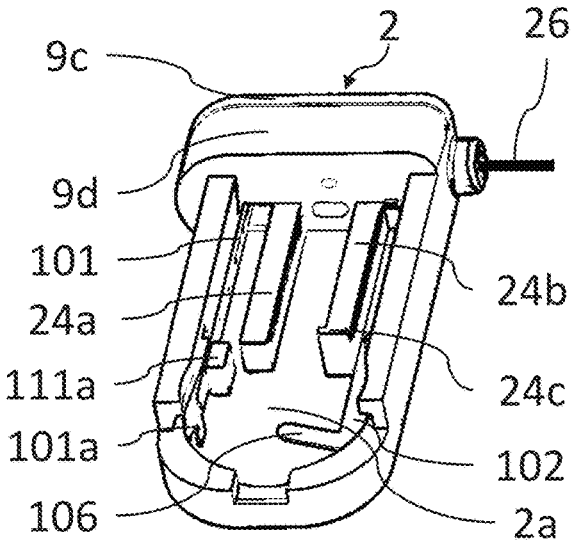
FIG. 29 shows part of the detection device from FIG. 27 and FIG. 28 in place in the frame body of the casing of the device.
Figure 30:
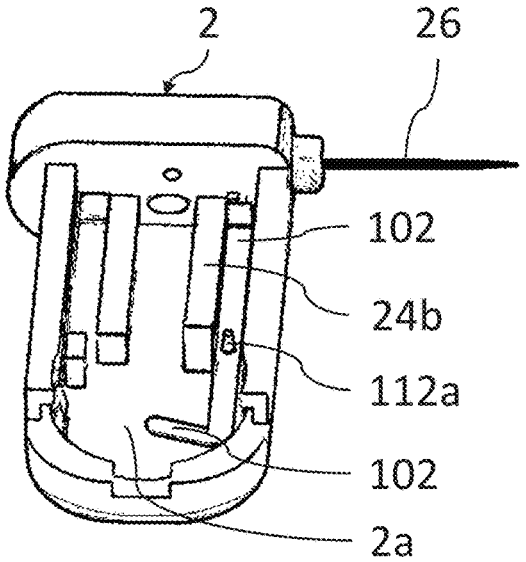
FIG. 30 also shows, from a slightly different viewing angle, the same part of the detection device from FIG. 25 and FIG. 26, in place in the frame body of the casing of the device, as FIG. 20.

The arrangement of the detection circuit in the body of the casing is illustrated in FIGS. 29 and 30 and in FIG. 6. The latter figure (i.e., FIG. 6) shows that the end 104 of the arm 102 rubs against the needle 26 when the latter is inserted in the guide channel 12 through the flange 19. Similarly, it shows that the end 110 of the arm 108 is retained inside a slot extending from front to rear along the direction of the axis Y, and thus transversely to the main axis of the conduit (e.g., guide channel 12) for the needle 26, which extends from right to left along the direction of the axis X.

Returning to FIGS. 29 and 30, it can be seen that the arm 101 is received in the body of the casing 9 between the left-hand edge of this casing and a pillar 111*a* extending from the back to the front from the bottom of the casing. Similarly, the arm 101 is received in the bottom of the casing between the right-hand edge of the casing and the rib (e.g., groove 24*b*) forming one of the guide rails for the base 22*a* of the trigger 22. It comprises a hole 102*a* that can interact with a pin 112*a*, which extends from the back to the front from the bottom of the casing, for better retention.

Figure 23:
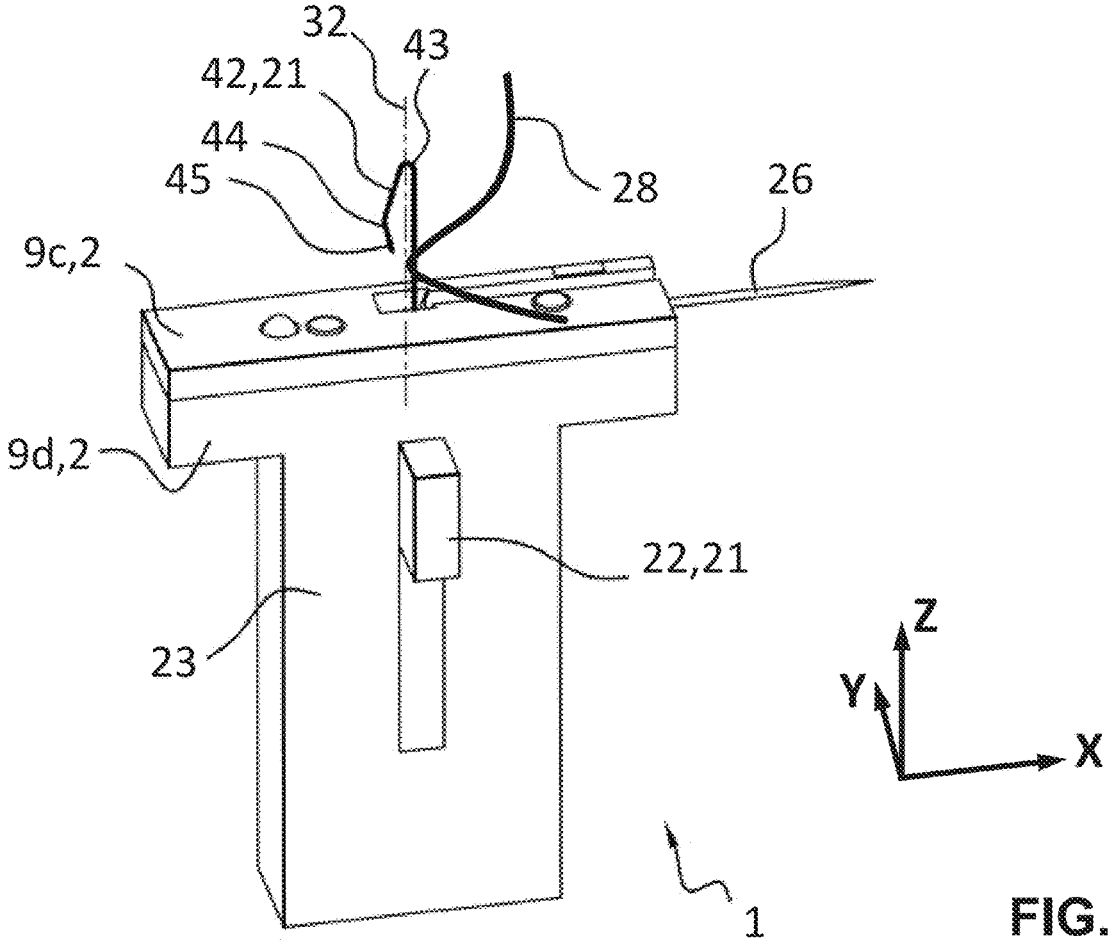
FIG. 23 is a schematic perspective representation of a device for assisting with threading an eyed needle, according to another embodiment of the disclosure.
Figure 24:
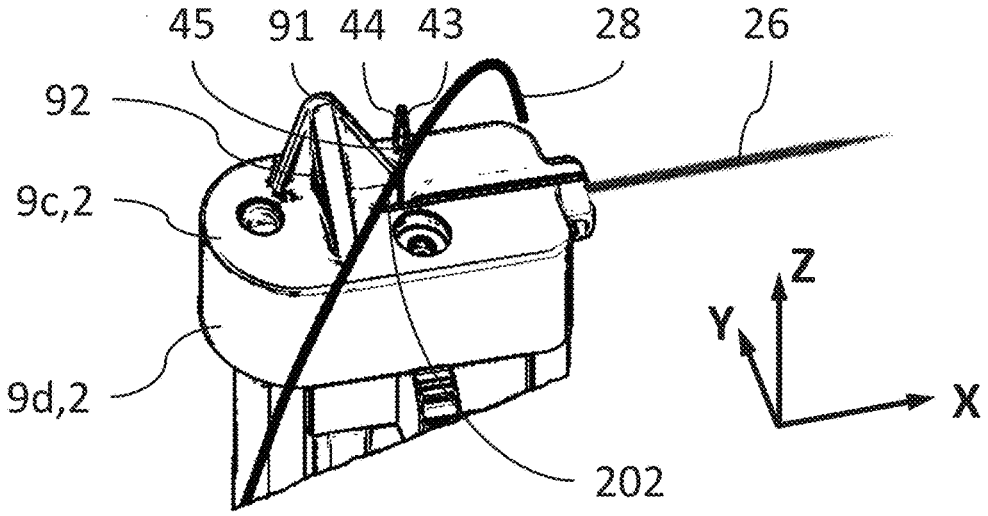
FIG. 24 is similar to FIG. 5, and shows the top of the device, slightly from above and slightly from the left, and illustrates the placement of a portion of sewing thread with a view to snagging it with the hook in the form of an open loop that is in the threading position in the figure.
Figure 25:
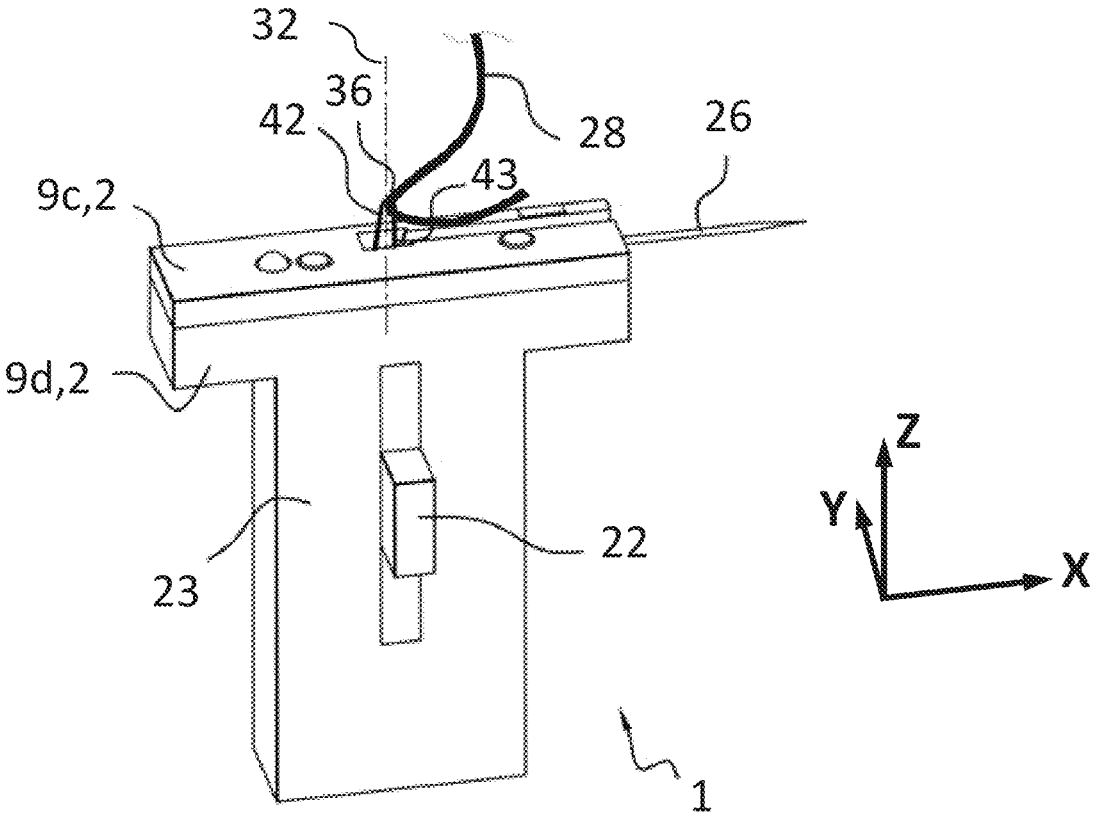
FIG. 25 is a schematic perspective representation of the device for assisting with threading an eyed needle, according to another embodiment of the disclosure, in which the hook is displaced toward the retracted position.
Figure 26:
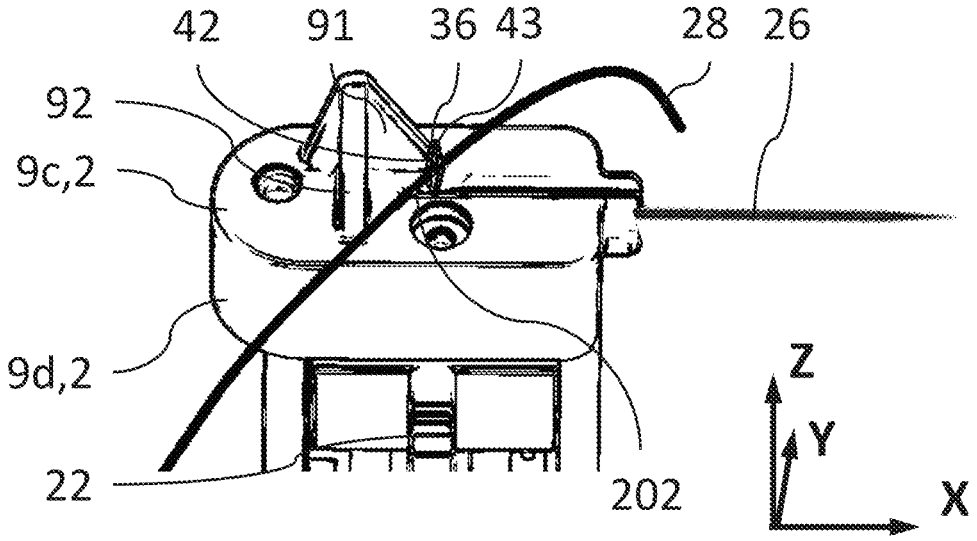
FIG. 26 is similar to FIG. 24 and shows the portion of sewing thread snagged by the hook in the form of an open loop that, in the figure, is in an intermediate position between the threading position and the retracted position, while the hook is being put back in the casing of the device to thread a needle with the sewing thread.

Another variant of the second embodiment of an assistance device 1, according to the disclosure, is shown in FIGS. 23 and 24, in which the hook is an open hook 42, which is illustrated in the threading position 21. The assistance device 1 is shown such that the axis 32 passing through the passage 4 extends substantially vertically such that a sewing thread 28 wraps around a first segment 43 having a longitudinal end supported by the means for drawing the hook 42, specifically the trigger 22. In this variant, the displacement of the open hook 42 from the threading position 21 to the retracted position 20 makes it possible to snag the sewing thread 28 with the hook 42, the sewing thread being received at the free end 36 of the hook (as shown in FIG. 25 and FIG. 26). As a result, the sewing thread 28 is drawn through the eye of the needle by displacement of the means for drawing the hook 42 from the threading position 21 to the retracted position 20. In this variant, all that is needed is to wrap the sewing thread 28 around the first segment 43 of the hook 42, such that the thread 28 extends in the gap formed between the first segment 43 and the second segment 44 of the hook, and then displace the trigger 22 from the threading position 21 to the retracted position 20 in order to thread the needle 26. The needle is threaded without the user needing to precisely target the opening of the eye of the needle and/or the free end 36 of the filiform loop 16, which they do in the other embodiments in which the hook is a closed loop.

This makes it easier to thread the needle 26.

Figure 31:
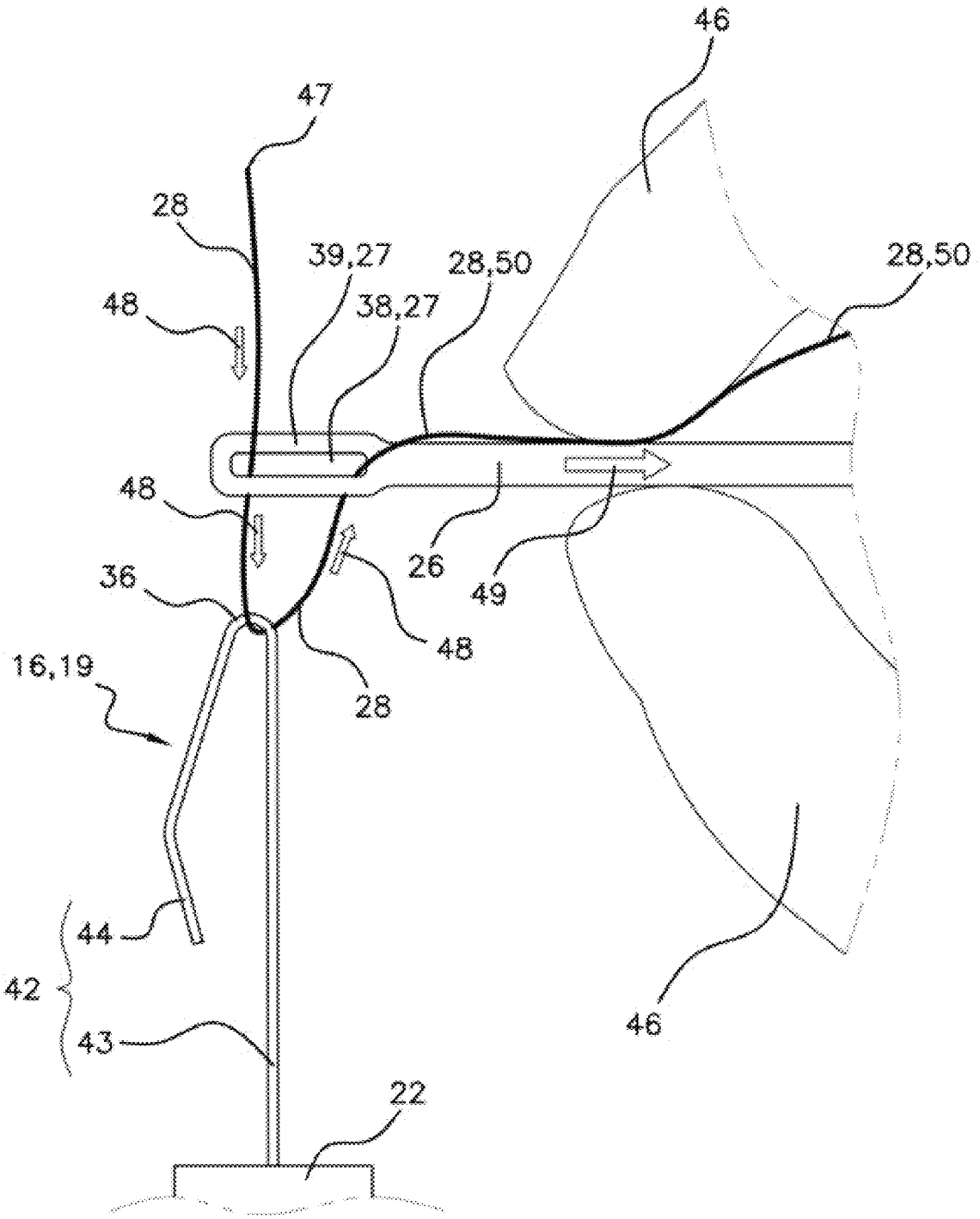
FIG. 31 is a schematic representation of a step of a method for threading a needle according to embodiments of the disclosure.

In an advantageous embodiment of a method for threading an eyed needle, according to the disclosure, use is made of a variant of an assistance device 1, according to the disclosure, comprising a solid body 2 provided with an open filiform hook 42 mounted integrally with a trigger 22, which is guided in displacement by a stiff frame 3 between the retracted position 20 and the threading position 21. With a user 46 having put the open hook 42 in the threading position 21 so as to protrude out of the solid body 2, the user 46 orients the assistance device 1 such that the axis 32 passing through the passage 4 extends substantially horizontally. In this orientation, the user 46 places a sewing thread 28 relative to the open hook 42 such that the thread 28 wraps around the first segment 43 of the open hook 42 and such that the displacement of the hook 42 from the threading position 21 to the retracted position causes the sewing thread 28 to be snagged on the free end 36 of the open hook 42 (as shown in FIG. 25) and causes the sewing thread 28 to be drawn through the eye 27 of the needle 26 and the latter to be threaded. In this advantageous embodiment, all that is needed is to wrap the sewing thread 28 around the first segment 43 of the hook 42, such that the thread 28 extends in the gap formed between the first segment 43 and the second segment 44 of the hook, and then displace the trigger 22 from the threading position 21 to the retracted position 20 in order to thread the needle 26. In this advantageous embodiment, all that is then needed, as shown schematically in FIG. 31, is for the user 46 to remove the threaded needle 26 from the threading assistance device 1 by taking up the needle 26 and one (and just one) of the two strands of thread 28 going through the eye 27 by pinching them, and by pulling on the needle 26 and the strand 50 of the pinched thread 28, along the axis of the guide channel 12 and in the direction indicated by the arrow 49, by sliding the needle in the guide channel 12, which means that a strand 47 of the sewing thread 28 is made to slide through the opening 38 of the eye 27 in the direction indicated by the arrow 48 and through the hook 16, 42. The result of this simple displacement of the needle 26 is that the threaded needle 26 and the hook 16, 42 are separated from one another, which means that the needle 26 is threaded in a single step and easily, with a single strand of sewing thread 28.

In this advantageous embodiment, there is nothing to preclude the needle 26 removed from the device with the strand 50 of thread 28 pinched by the user 46 from being oriented along the axis 32 of the passage 4 of the device 1, according to the disclosure, which is substantially parallel to the axis of elongation of the hook 16, 42, and then continuing to pull on the needle 26 and the pinched strand of thread 28, along this axis 32 of the passage 4. This makes it easier to slide the thread 28. In this advantageous embodiment, the two strands of the thread 28 that are threaded in the needle 26 are brought substantially in line with the axis 32 in displacement in the recess 25 of the solid body 2. In this advantageous embodiment, the threaded needle 26 is removed from the device 1 in a single movement that makes it possible to thread the sewing needle 26 with a single strand of sewing thread 28.

Of course, in all of the embodiments of the disclosure, the assistance device makes it easier to thread an eyed needle with a portion of free thread, which is to say a portion of thread independent of a spool of thread, or with a portion of thread of which only a first longitudinal end is free, the other longitudinal end being retained in a spool of thread.

In some embodiments of an assistance device, according to the disclosure, which are not shown and in which the hook is an open hook, the solid body of the device, according to the disclosure, forms a bulge for positioning the sewing thread in contact with the hook, such that the displacement of the hook from the threading position to the retracted position causes the thread to be snagged on the hook.

In the embodiments shown in the figures, this positioning bulge is designed like a pointed L-shaped peg, with two wings 91 and 92 that fall away and are disposed at an angle, with the point facing upward. More specifically, the point in question is formed by the end of the edge corner shared by the two wings 91 and 92 of the L shape, which extends from the plane of the upper face of the casing 9 (and, more particularly, of the part 9*c*) away from the plane in the direction orthogonal to the plane. The edges of the L shape, formed by the respective edge faces of the wings 91 and 92, fall away toward this plane from this shared edge corner. In other words, the wings 91 and 92 of the L shape fall away, which is to say that they are arranged in the form of "delta" wings with an angle between them. Advantageously, their angular opening faces toward the orifice of the funnel 202 for putting the hook 16 back in, which is to say also toward the hook 16 when the latter has come out of the casing 9, in its threading position 21.

In the example shown in the figures, the two wings 91 and 92 of the L shape are disposed with an angle between them that is substantially equal to 90°. This angle value is an advantageous but nonlimiting example. An angle ranging between approximately 60° and approximately 120°, or even between approximately 30° and approximately 150°, is also conceivable.

During use of the device for assisting with threading a needle according to this embodiment, the user puts a portion of sewing thread 28 in the vicinity of the point formed by the falling-away wings 91 and 92, on the side of which falling-away wings 91 and 92, which is to say between the wings 91 and 92 on the one hand and the hook 42 on the other hand, with the hook being out, in the threading position. The user can then easily make the portion of sewing thread 28 slide along the edge faces of the wings 91 and 92, from the point toward the bottom of the L shape. Given that the wings 91 and 92 fall away toward the orifice of the funnel 202, as mentioned above, the sewing thread specifically naturally falls toward the hook 42, underneath the free end 45 of the second segment 44 of the open hook 42. This makes it a lot easier to snag the thread 28 in the hook 42, when the latter is then brought downward in the direction of the axis Z into the casing 9 into the retracted position. This is because the user would not have to pass a free end of a portion of sewing thread into the diamond formed by the loop of the hook 16 themselves, which is the case in the embodiments in which the hook is in the form of a closed loop.

It will be noted that, even in the embodiments in which the hook is a closed loop (such that the sewing thread 28 cannot be snagged in the hook as described above), the pointed L shape of wings 91, 92 is still advantageous. This is because, irrespective of the embodiment of the hook 16, whether in the form of an open loop or in the form of a closed loop, the pointed L shape of the wings 91, 92 protects the end of the hook that protrudes out of the casing 9 against the risk of being bent, which is to say turned down toward the plane of the part 9*c* of the casing 9. Such bending can be caused by a gesture on the part of the user, or poor handling of the device 1 when the hook is in the threading position, protruding from the casing 9 of the device. In spite of the natural elasticity of the wire from which the hook 16 or 42 is formed, this bending could damage the device, by preventing, for example, the hook from being able to return to the retracted position by moving the trigger toward the bottom of the device 1.

In some other embodiments of the assistance device 1, according to the disclosure, in which the hook is an open hook 42, the end of the passage passing through the solid body and extending opposite the guide portion forms a funnel 202 for guiding the hook in displacement from the threading position 21 to the retracted position 20. Notably, this funnel 202 serves to make it easier to put the hook back into the body 2 of the casing 9. Specifically, as a result, this embodiment is, therefore, particularly suitable for implementing a hook 42 in the form of an open loop, as shown in FIGS. 5 to 8, 13, 23, and 24. This is because the funnel 202 for putting the hook back into the solid body 2 makes it easier to displace the hook from the threading position 21 in which the end point 36 is outside the solid body 2 to the retracted position 20 in which the hook has been put entirely back into the body. In particular, the displacement of the free end 45 of the second segment 44 of the open hook 42 so as to fit into the passage 4 in order for the hook 16 to be put back into the solid body 2 is made more secure. This avoids the free end 45 of the loop from being able to snag on the upper edge of the casing 9; this could cause the hook 42 to open up by the second segment 44 being moved away from the first segment 43 of the open hook 42, possibly irreversibly.

There may be numerous variants and applications of embodiments of the disclosure, other than those described above. In particular, it goes without saying that, unless indicated otherwise, the different structural and functional features of each of the embodiments described above should not be considered as being combined and/or intrinsically and/or inextricably linked with one another, but, by contrast, as being simple juxtapositions. Moreover, the structural and/or functional features of the different embodiments described above may be subject in full or in part to any other juxtaposition or any other combination.

The invention claimed is:

1. A device for assisting with threading an eyed needle, to facilitate the threading of the needle with a sewing thread, the eye of the needle being of a type peripherally delimited by a rim extending substantially in a plane, referred to as opening plane of the eye, the assistance device comprising:

a solid body forming:

a receiving portion, referred to as eye receiving portion, designed to be able to receive the eye of the needle and hold the needle in position in relation to the solid body; and a passage in the solid body and comprising a portion, referred to as guide portion;

a first end of the guide portion emerging to the outside of the solid body;

a second end of the guide portion emerging in the eye receiving portion;

a filiform hook made of a material that is elastically deformable in flexion while it is being displaced through the eye of the needle and in contact with the guide portion;

means for drawing the filiform hook into the guide portion of the filiform hook, in displacement along a direction parallel to an axis of elongation of the guide portion between a retracted first position, in which a free end of the filiform hook extends entirely in the guide portion, and another position, referred to as threading position, in which the filiform hook extends through the opening plane of the eye and in which at least part of the filiform hook extends out of the solid body of the device;

a trigger forming part of the means for drawing the filiform hook, the filiform hook being mounted integrally with the trigger so as to be able to be drawn, by actuating said the trigger, in displacement between the retracted first position and the threading position; and a stiff frame for guiding the trigger and the filiform hook in displacement, the free end of the filiform hook being designed to interact with a wall of the guide portion so as to be guided toward the opening plane of the eye and pass through it when the filiform hook is being displaced between the retracted first position and the threading position, and to interact with a sewing thread such that the displacement of the filiform hook from the threading position to the retracted first position makes it possible to thread the needle, wherein the guide portion forms a first funnel for guiding the filiform hook to bring the filiform hook out of the retracted first position and into the threading position, and a second funnel for returning the filiform hook to the retracted first position from the threading position, each time through the eye of the needle, and drawing the sewing thread through when the filiform hook is being returned to the retracted first position from the threading position.

2. The device of claim 1, wherein the solid body is formed in one piece.

3. The device of claim 1, wherein the solid body is formed of at least two parts that have complementary shapes and are designed to be able to interact with one another and be reversibly connected to one another so as to form the solid body.

4. The device of claim 1, wherein the wall of the guide portion is a smooth peripheral internal guide wall.

5. The device of claim 1, wherein the guide portion has a cross section that decreases from its first end emerging to the outside of the solid body to its second end emerging in the eye receiving portion.

6. The device of claim 1, wherein the guide portion has a frustoconical shape with a cross section that decreases from its first end emerging to the outside of the solid body to its second end emerging in the eye receiving portion.

7. The device of claim 1, wherein the second end of the guide portion has an opening that emerges in the eye receiving portion and is disposed so as to extend facing the eye of the needle to be threaded.

8. The device of claim 1, wherein the solid body forms a guide channel for guiding the eye of the needle in displacement in the solid body up to the eye receiving portion.

9. The device of claim 8, wherein the guide channel has a circular overall shape in any cross section transverse to the axis of elongation of the guide channel.

10. The device of claim 8, wherein the guide channel has two longitudinal grooves, which that are radially opposite one another and are designed to be able to each interact with opposite parts of the rim of the eye and guide the eye of the needle in displacement in the guide channel up to the eye receiving portion.

11. The device of claim 10, wherein the longitudinal grooves extend into the eye receiving portion, in which they interact so as to be able to hold the eye of the needle in place such that the opening plane of the eye extends facing the second end of the guide portion that emerges in the eye receiving portion.

12. The device of claim 1, wherein the eye receiving portion is provided with a detection member for detecting the position of the eye of the needle in abutment with the eye receiving portion.

13. The device of claim 12, wherein the detection member is a sensor coupled to a light-emitting diode that indicates that the eye of the needle is in abutment with the eye receiving portion.

14. The device of claim 1, wherein the filiform hook extends substantially in a plane and has a longitudinal end point designed to be able to be fitted into the opening plane of the eye and to progress such that the filiform hook goes through the eye.

15. The device of claim 1, wherein the filiform hook is an open filiform hook formed of two successive segments of metal wire that are folded on one another, the two successive segments being a first segment having a longitudinal end supported by the means for drawing the open filiform hook and a second segment having a free end, the first segment and the second segment being shaped so as to be able to interact with the sewing thread such that the open filiform hook allows the sewing thread to be snagged by displacement of a loop of the sewing thread to be wrapped around the first segment up to the longitudinal end of the open filiform hook, which means that the sewing thread is drawn through the eye of the needle by displacement of the means for drawing the open filiform hook from the threading position to the retracted position.

16. The device of claim 1, wherein the filiform hook is a filiform loop closed on itself and extending substantially in a plane and forming a longitudinal end point designed to be able to be fitted in the opening plane of the eye.

17. The device of claim 14, wherein the filiform hook is made of at least one material that is elastically deformable in flexion between:

a first shaping, referred to as deformed shaping, of the filiform hook in which the filiform hook is elastically deformed owing to passage of the filiform hook through the opening plane of the eye; and a second shaping, referred to as threading shaping, of the filiform hook, that is distinct from the deformed shaping and in which the filiform hook is shaped so as to be able to interact with the sewing thread and allow the sewing thread to be snagged, wherein the filiform hook can be elastically brought from the deformed shaping to the threading shaping after the filiform hook, has passed through the opening plane of the eye.

18. The device of claim 1, wherein the stiff frame for guiding the trigger and the filiform hook is integral with the solid body.

19. The device of claim 8, wherein the solid body defines a recess extending from the guide channel and emerging to the outside of the solid body, the recess being designed to allow passage of two strands of the sewing thread extending upstream and downstream of the eye of the needle, while the needle is being withdrawn from the guide channel.

20. A method for threading an eyed needle, the eye being of a type peripherally delimited by a rim extending substantially in a plane, referred to as opening plane of the eye, and wherein:

the of the needle is disposed in the eye receiving portion of the device of claim 1, such that the opening plane of the eye extends facing the second end of the guide portion that emerges in the eye receiving portion; and the method comprises:

introducing a sewing thread into the first end of the guide portion, comprising the sewing thread being drawn by the filiform hook in displacement in the guide portion up to the eye receiving portion, such that the sewing thread passes through the eye of the needle, which means that the needle is threaded; and removing the threaded needle from the device of claim 1.

21. A method for manufacturing the device of claim 1, the method comprising forming the solid body by hot molding a solid thermoplastic material.

* * * * *